US006189449B1

(12) United States Patent
Tomita et al.

(10) Patent No.: US 6,189,449 B1
(45) Date of Patent: Feb. 20, 2001

(54) WIDTH ADJUSTING DEVICE AND METHOD FOR A PAPER WEB, AND ROTARY LITHOGRAPHIC PRESS HAVING SAME

(75) Inventors: Yuko Tomita, Akishima; Masayoshi Sato, Kawasaki; Takashi Iijima, Yokosuka; Hideo Ohta, Tokyo, all of (JP)

(73) Assignee: KabushikiGaisha Tokyo Kikai Seisakusho, Tokyo (JP)

( * ) Notice: Under 35 U.S.C. 154(b), the term of this patent shall be extended for 0 days.

(21) Appl. No.: 08/381,423

(22) Filed: Jan. 31, 1995

Related U.S. Application Data

(62) Division of application No. 08/101,488, filed on Aug. 3, 1993, now abandoned.

(30) Foreign Application Priority Data

Oct. 23, 1992 (JP) ..... 4-309476

(51) Int. Cl.[7] ..... B41F 5/16; B41F 5/18; B41F 13/02; B41F 5/04

(52) U.S. Cl. ..... 101/180; 101/178; 101/219; 101/225

(58) Field of Search ..... 101/148, 181, 101/220, 228, 178–180, 139, 138, 219, 225; 226/15, 17, 20

(56) References Cited

U.S. PATENT DOCUMENTS

| | | | | |
|---|---|---|---|---|
| 3,098,432 | | 7/1963 | Bechtold et al. | 101/181 X |
| 3,147,898 | * | 9/1964 | Huck | 226/17 |
| 4,303,189 | | 12/1981 | Wiley et al. | 226/17 X |
| 4,589,650 | * | 5/1986 | Miyoshi | 271/242 |
| 4,696,230 | * | 9/1987 | Barkley | 101/181 |
| 4,831,926 | | 5/1989 | Bowman et al. | 101/138 |
| 5,052,296 | * | 10/1991 | Shiba | 101/227 |
| 5,152,222 | * | 10/1992 | Okamura et al. | 101/178 X |
| 5,619,921 | * | 4/1997 | Iijima et al. | 101/181 |

FOREIGN PATENT DOCUMENTS

3513319 * 10/1986 (DE) .

OTHER PUBLICATIONS

Laubscher, H., "Stacked Modular Press Configuration or Satellites–A Systematic Comparison", *INFA Newspaper Techniques English Edition,* Apr. 1988, pp. 64–73.

* cited by examiner

*Primary Examiner*—Kimberly Asher
(74) *Attorney, Agent, or Firm*—Foley & Lardner

(57) ABSTRACT

A web width adjusting device comprises a pressure force applying unit for applying pressure force to one side surface of a paper web which is successively traveled through two or more printing sections. Further the web width adjusting device may also include a counter pressure applying unit to apply counter pressure to the other side surface of the paper web. The pressure applying unit (and the counter pressure applying unit) deformes the paper web in a wavy surface which causes the width of the paper web to be shortened. The adjusting factors for the web width are controlled by automatic control system which detects traveling condition of the paper web, the generation of shears in printing, etc.

19 Claims, 22 Drawing Sheets

WIDTH ADJUSTING DEVICE AND METHOD FOR A PAPER WEB, AND ROTARY LITHOGRAPHIC PRESS HAVING SAME

This application is a division of (and claims benefit of priority of) application Ser. No. 08/101,488 filed Aug. 3, 1993, now abandoned.

BACKGROUND OF THE INVENTION

1. Field of the Invention

The present invention generally relates to a width adjusting device for a paper web, which adjusts the width of the paper web for a printing system prior to a printing section. More particularly, the present invention relates to a rotary lithographic press which is equipped with at least one of the width adjusting device and a plurality of printing sections through which the paper web is successively travelled to be printed.

2. Description of the Prior Art

A typical conventional rotary lithographic press adapted for a multi-color printing system is, for example shown in FIG. 22 which is a schematically elevational view. This conventional lithographic printing system comprises a plurality of printing sections P, each of which includes two pairs of a combination of a plate cylinder PC and a blanket cylinder BC. The blanket cylinders BC of each printing section P are vertically arranged to be in contact with each other. In this conventional printing system, four sets of the printing sections P are horizontally arranged in parallel as shown in FIG. 22. A paper web W is also horizontally travelled through the printing sections in which the paper web W is successively passed between the pairs of blanket cylinders BC, BC to print both sides of the paper web W.

Another conventional rotary lithographic press or a multi-color printing system is shown in FIG. 23. In this drawing, four printing sets, each composed of a plate cylinder PC and a blanket cylinder BC are radially arranged about an impression cylinder IC as a common center cylinder. The blanket cylinders BC are respectively in contact with the impression cylinder IC to form printing sections P. A paper web W is travelled along the circumference of the impression cylinder IC so that the paper web W is successively passed through the four printing sections P defined between the blanket cylinders BC and the impression cylinder IC to print one side of the paper web W.

In recent years, many newspaper publishers have progressed to bring newspaper in multi-color ink and thus demand the capability of color printing on many pages at a high speed in a limited printing space.

In order to satisfy such demands, another conventional rotary lithographic press for a color printing system has been proposed as shown in FIG. 24 and FIG. 25. In this printing system, each printing section P includes two sets of a blanket cylinder BC and a plate cylinder PC which are symmetrically arranged so as to bring the blanket cylinders BC into contact with each other. A paper web W is vertically travelled through the four printing sections P to print both sides of the paper web W in the same manner as the above described systems. This type of printing system is, for example, shown in "IFRA Newspaper Techniques English Edition", pp.64 to pp.73; April, 1988 published by INCA-FIEJ Research Association.

Paper webs used in various printing systems are generally produced in such a manner that pulp fibers are mechanically cut and broken into fine particles, dispersed in water, dehydrated and dried, and finally adhered by hydrogen-bond to form paper in a web or sheet figure. Under moist conditions, each pulp fiber tends to extend a little less than 1 percent in length and 20 to 30 percent in width. Thus the size of the paper web is increased, both longitudinally and laterally by a dampening and/or watering process. Most pulp fibers of general mechanically produced paper webs are orientated in the longitudinal direction of the paper web, so that paper webs are remarkably extended in their width.

In a specific lithographic printing system which employs a dampening or watering operation in printing, a paper web is swelled by the water supplied during the dampening operation. Therefore the image and lines printed on the paper web are also deformed in response to the swell of the paper web. In printing systems that include at least two lithographic printing sections each associated with dampening means to successively print color images on the same paper web, the printed images or lines formed by the first printing section are not correctly accorded with the images or lines formed by the second and later printing sections. Accordingly, this will produce printed materials of poor quality.

BRIEF SUMMARY OF THE INVENTION

Therefore, it is a primary objective of the invention to provide an improved width adjusting device for a paper web, which can be associated with a lithographic color-printing system that includes at least two printing sections using dampening means to successively print images and lines on the same paper web, and which can adjust the width of the paper web to correctly align the former printed image with the succeeding printing image.

Another objective of the present invention is to provide an improved width adjusting method for a paper web to successively print images and lines on the same paper web without any shears.

To accomplish the above described objective, a web width adjusting device according to the present invention is comprised of at least one pressure force applying means to at least one side surface of a paper web which is successively travelled through two or more printing sections.

The web width adjusting device may also include means of applying counter pressure to the side surface of the paper web.

Another characteristic of the present invention is that the web width adjusting method comprises at least one step for applying pressure force to at least one side surface of a paper web travelling through two or more printing sections so that the width of the paper web can be adjusted to align the printed pattern formed at the preceding printing step with that formed at the successive printing steps.

Further, the web width adjusting method may include a step for applying counter pressure to the side surface of the paper web.

In the width adjusting device according to the present invention, the paper web is subjected to pressure from a pressure force applying means along the width of the paper web. This pressure causes the paper web to form a wave as it is travelled toward the succeeding printing section. This wave-forming results in cancelling the expansion in the width of the paper web owing to water supplied from the preceding printing section. Therefore, the image and lines printed at the preceding printing section can coincide with those of the succeeding printing sections.

Other objectives and features of the invention will be apparent from a reading of the following description of the disclosure found in the accompanying drawings, and the novelty thereof pointed out in the appended claims.

DETAILED DESCRIPTION OF THE PREFERRED EMBODIMENT

One preferred embodiment of the present invention will be described in detail with references to the accompanying drawings.

Figure 1:
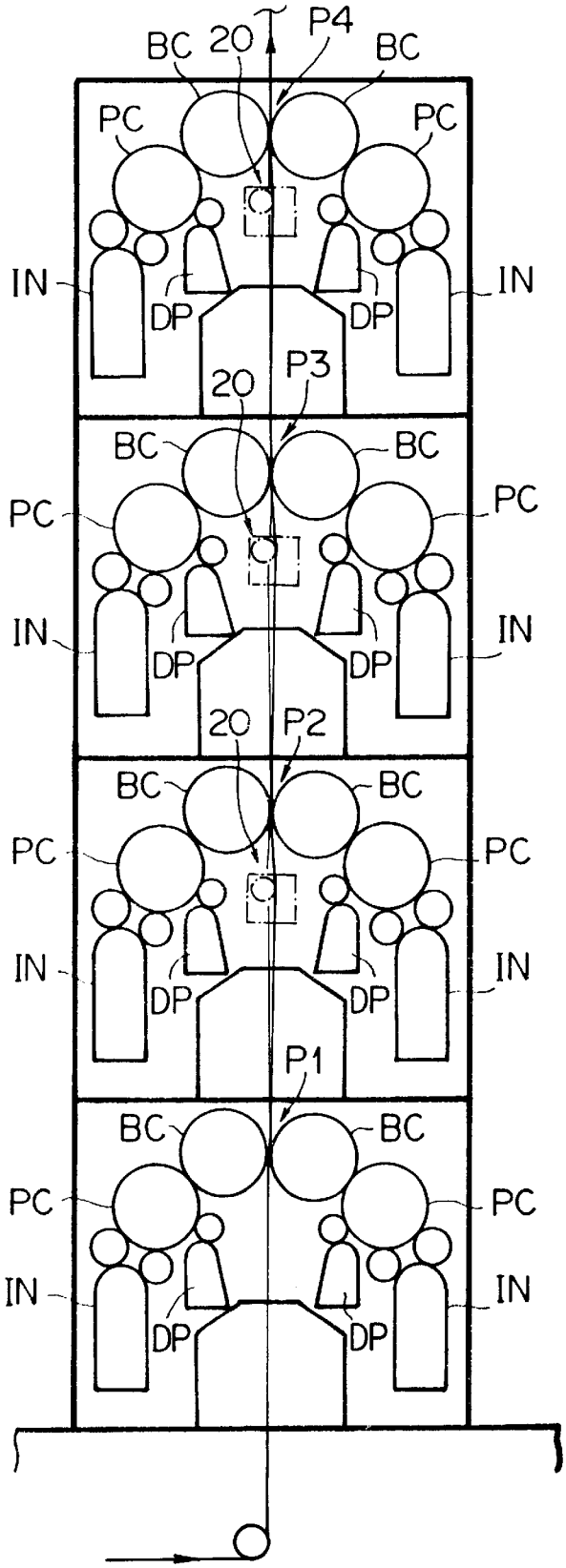
FIG. 1 is a schematic illustration showing the overall construction of a rotary lithographic press which is associated with a plurality of web width adjusting devices according to the present invention.
Figure 25:
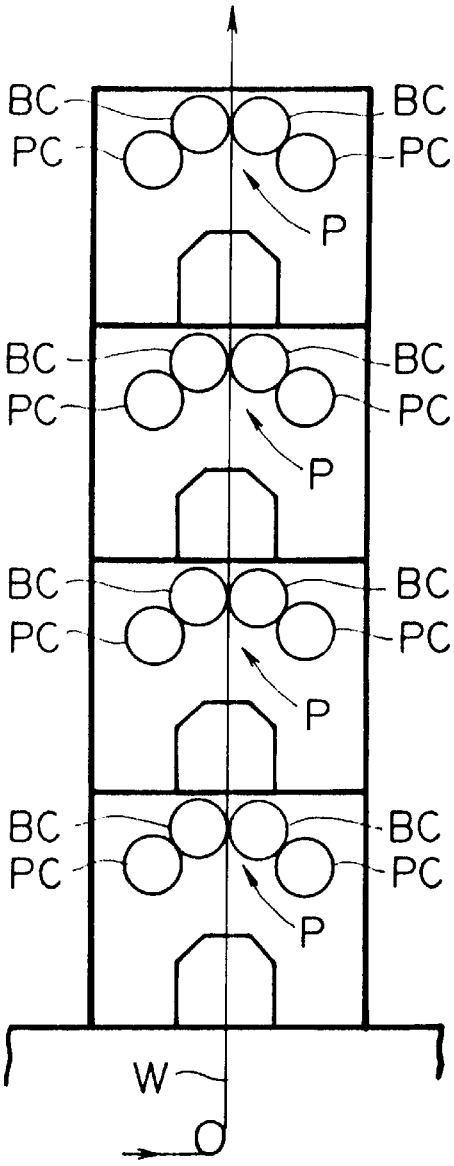
FIG. 25 PRIOR ART
FIG. 25 is schematic illustration showing another conventional configuration of a commonly used rotary lithographic press

In FIG. 1, there is shown an overall constitution of a rotary lithographic press which comprises first to fourth printing sections P1, P2, P3 and P4 vertically arranged in the same manner as the above described conventional color-printing rotary lithographic press shown in FIG. 25. Each printing section includes two sets of a blanket cylinder BC and a plate cylinder PC which are symmetrically arranged so as to bring the blanket cylinders BC into contact with each other. A paper web W is vertically travelled from the first printing section P1 to the fourth printing section P4. Additionally, the rotary lithographic press shown in FIG. 1 comprises a plurality of web width adjusting devices 20, described later in detail with references to FIG. 2 to FIG. 21.

In FIG. 1, IN and DP respresent an inking unit and a dampening unit, respectively.

Figure 2:
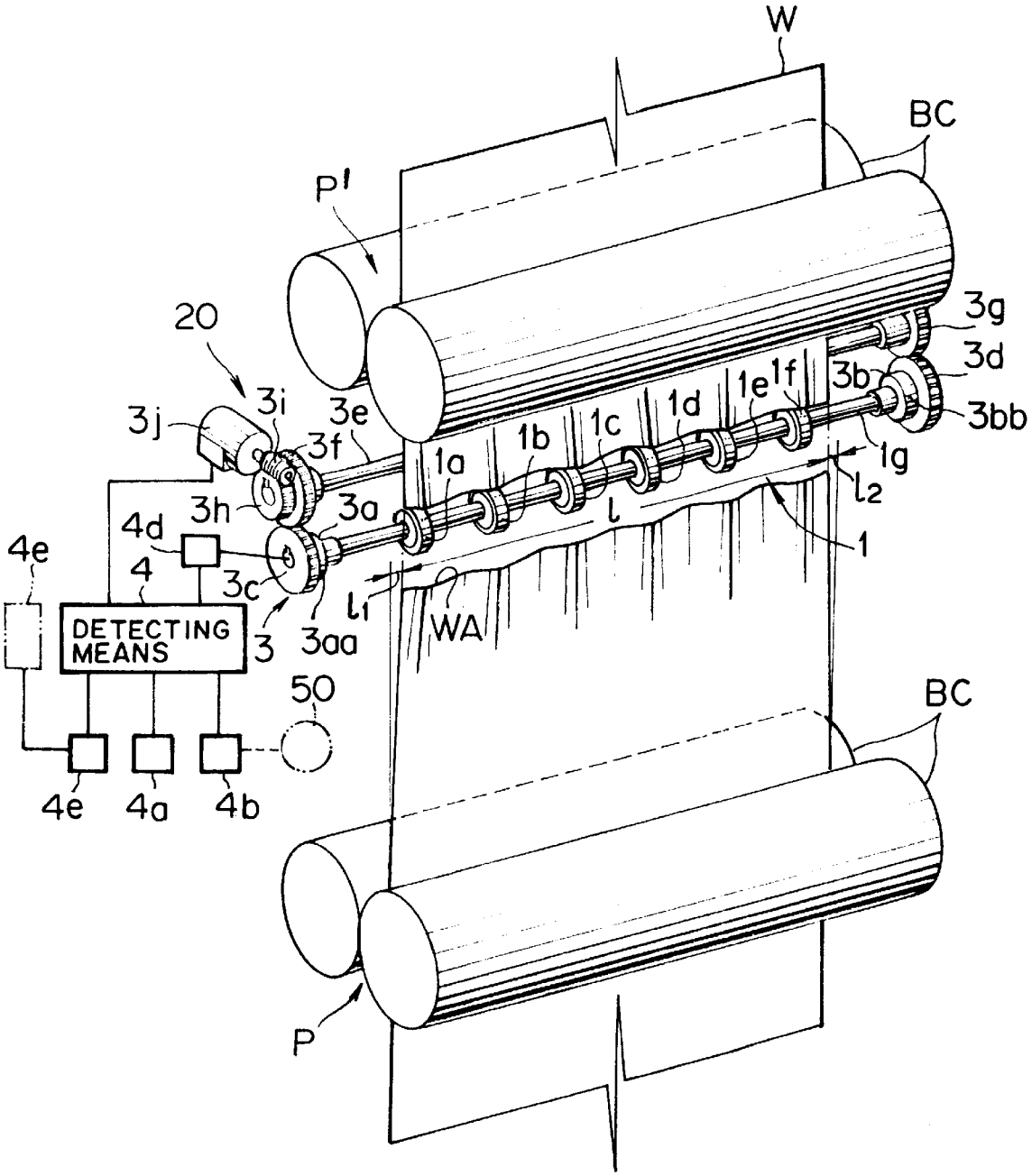
FIG. 2 is a schematically perspective view showing the first embodiment of a web width adjusting device according to the present invention.

The web width adjusting device 20 is typically shown in FIG. 2, as a first embodiment, wherein the device 20 is comprised of a pressure force applying means 1 which provides pressure to one side surface of the paper web W. The pressure force applying means 1 includes a plurality of contact rollers 1*a*, 1*b*, 1*c*, 1*d*, 1*e* and 1*f* which are separated from each other a regular interval and rotatably assembled on a shaft 1*g*. The shaft 1*g* is extended in the lateral direction of the paper web W and its ends are mechanically connected to a primary shift mechanism 3 for shifting the contact surface of the rollers 1*a* to 1*f* towards and away from the wave surface W.

The first shift mechanism 3 includes eccentric sleeves 3*a* and 3*b* which are rotatably mounted on a frame, not shown, through end members 3*aa* and 3*bb*. Further, the eccentric sleeves 3*a* and 3*b* are provided at their ends with end gears 3*c* and 3*d* respectively which are rotated with the connected sleeves 3*a* and 3*b*. An auxiliary shaft 3*e* is extended along the width of the paper web W and arranged in parallel with the shaft 1*g* so that the paper web W is passed between the shaft 1*g* and the auxiliary shaft 3*e*. The end gears 3*c* and 3*d* are meshed with end gears 3*f* and 3*g* fixed to the ends of the auxiliary shaft 3*e*.

The end gear 3*f* is further provided with a worm wheel 3*h* which is integrally rotated with the end gear 3*f*. The worm wheel 3*h* is meshed with a worm 3*i* fixed to a shaft of the driving means 3*j*.

The driving means 3*j* is controlled by a control means 4 which is electrically operated by an input means 4*a*, such as a key board, and a primary detecting means 4*b* for various operation information such as speed of a main motor 50 representing the traveling speed of the paper web W. The control means 4 is also electrically connected to a second detecting means 4*c* for detecting shears in the printed pattern on the paper web W; for example, the difference between shearing degree at the center region of the paper web and that at the side ends of the web W, and a third detecting means 4*d* for detecting the rotational phase of the eccentric sleeve 3*a*. Further the control means 4 is connected to the driving means 3*j*. The detecting means 4*c* includes a sensing element 4*e*.

Although FIG. 2 shows one example of the control system using the control means 4 communicated with only the first shift mechanism 3 as a matter of convenience. The control means 4 may be communicated with a plurality of shift mechanisms 3 shown in FIG. 2. Additionally, the control means 4 may be communicated with the driving means 3*j* and the detecting means 4*b*, 4*c* and 4*d* through any type of radio communication system.

FIG. 3 to FIG. 7 show the second to sixth embodiments of the present invention which employ various configurations of the pressure force applying means 1 of the width adjusting device. In these drawings, the control means 4 and both the driving and detecting means which are associated to the control means 4 are not shown because these mechanisms are configured as essentially same as the first embodiment.

Figure 3:
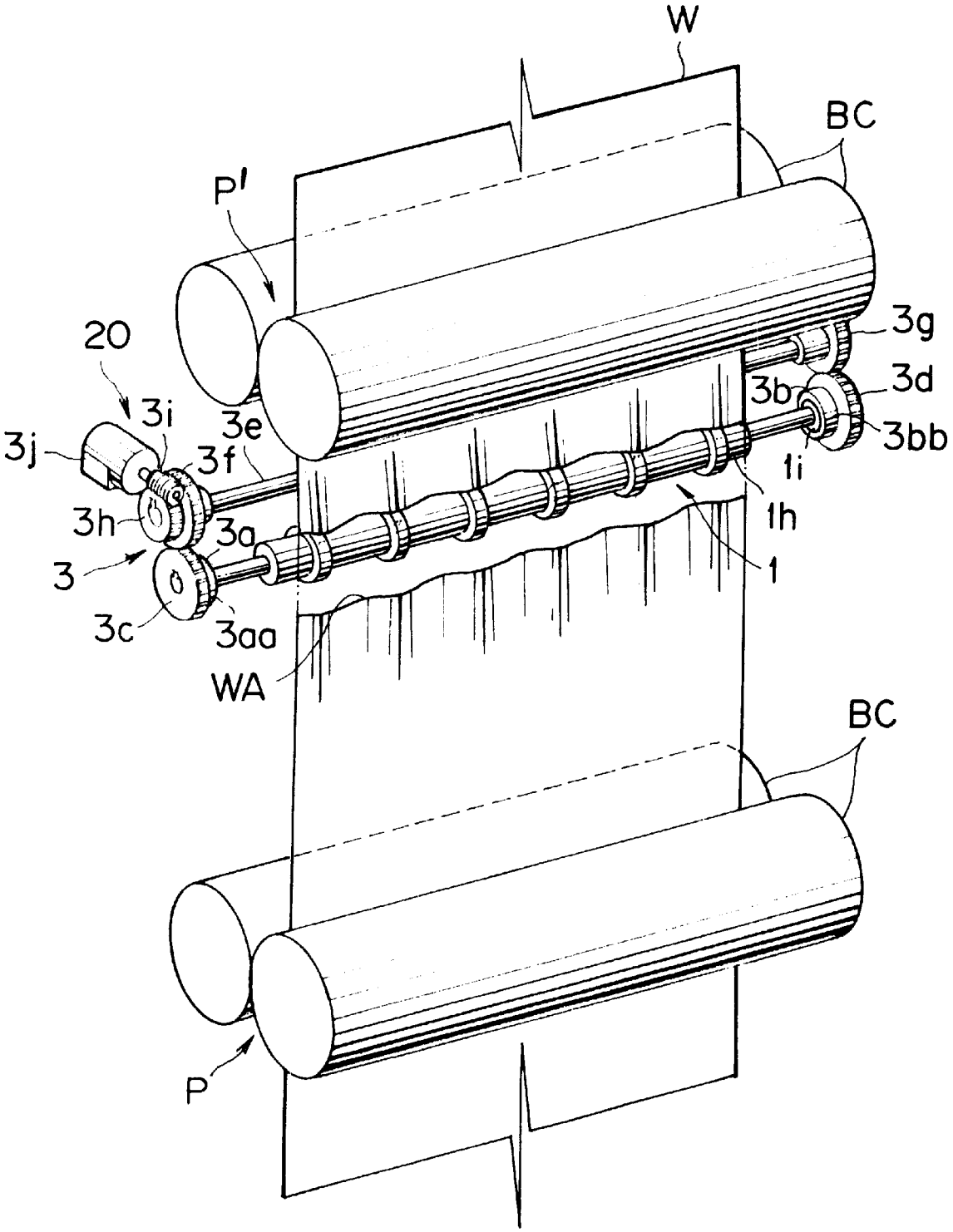
FIG. 3 is a schematically perspective view showing the second embodiment of a web width adjusting device according to the present invention.

In FIG. 3, the pressure force applying means 1 of the second embodiment includes a contact shaft 1*h* with a plurality of convex sections. This contact shaft 1*h* is extended in the lateral direction of the paper web W, and its ends are rotatably supported by eccentric sleeves 3*a*' and 3*b*' through bearings 1*i* and 1*i* (one side is not shown).

Figure 4:
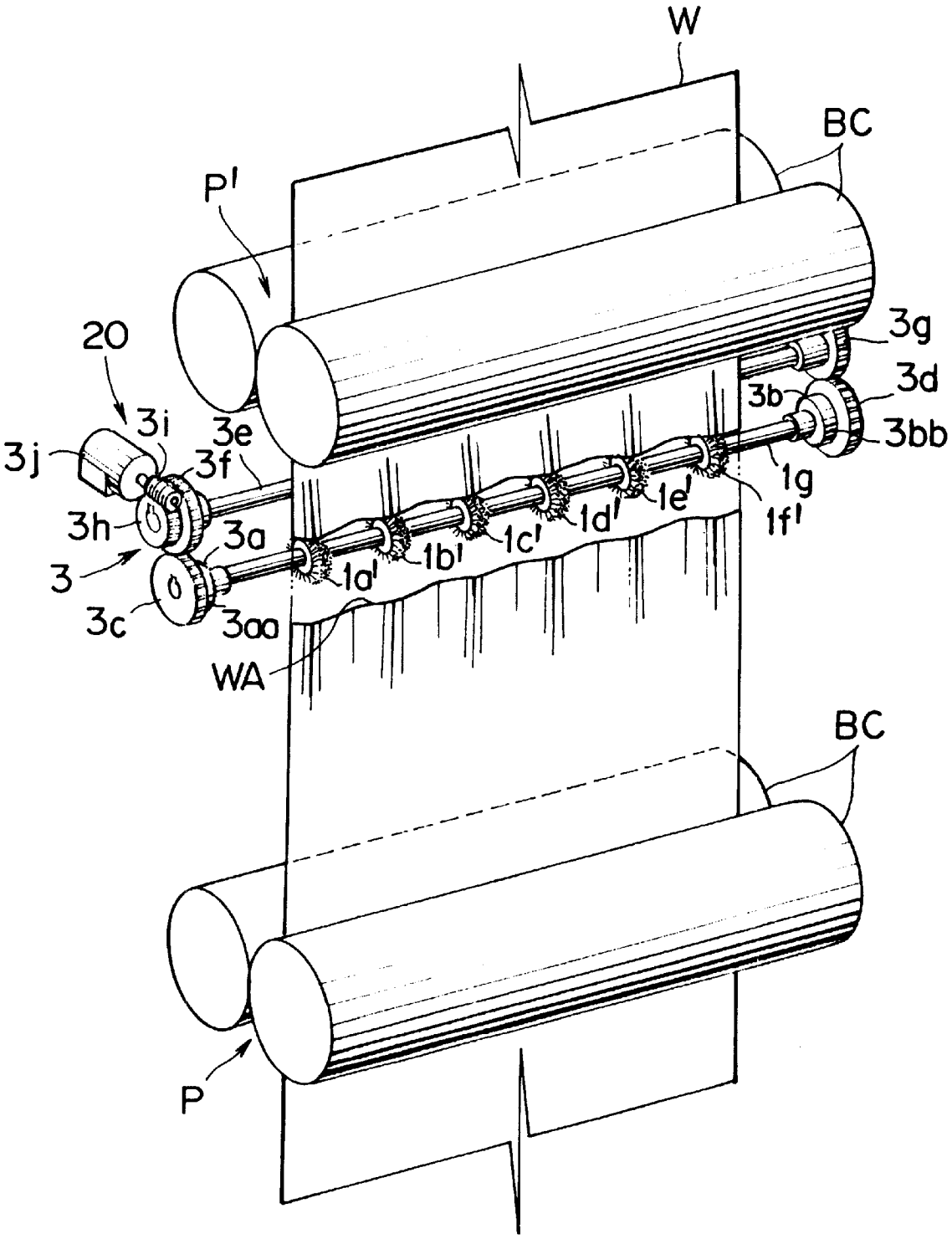
FIG. 4 is a schematically perspective view showing the third embodiment of a web width adjusting device according to the present invention.

In FIG. 4, the pressure force applying means 1 of the third embodiment includes a plurality of brush rollers 1*a*', 1*b*', 1*c*', 1*d*', 1*e*' and 1*f*' which are separated from each other at a regular interval and rotatably assembled on shaft 1*g* in the same manner as the first embodiment.

Figure 5:
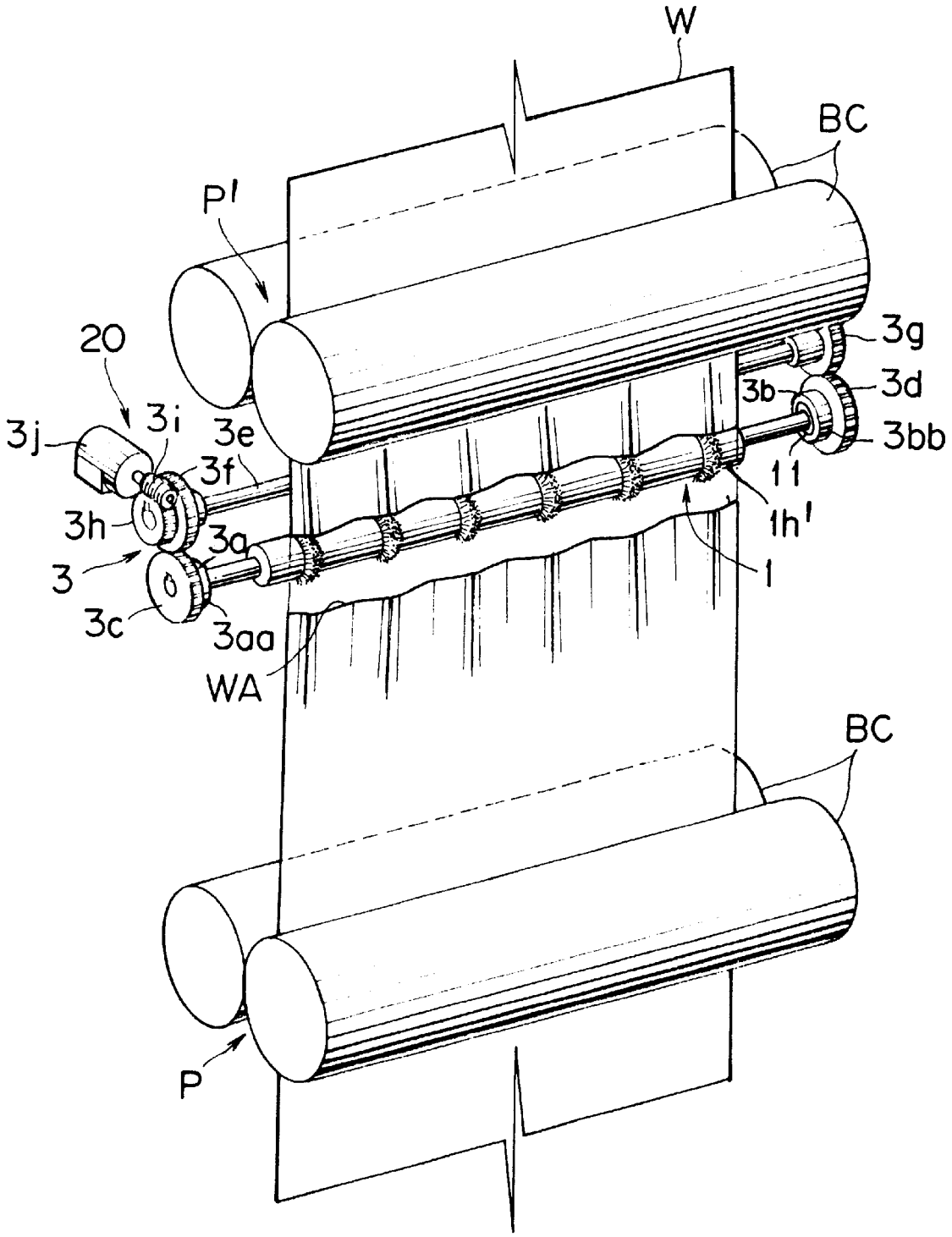
FIG. 5 is a schematically pespective view showing the fourth embodiment of a web width adjusting device according to the present invention.

In FIG. 5, the pressure force applying means 1 of the fourth embodiment includes a contact shaft 1*h*' with a plurality of brush convex sections. This contact shaft 1*h*' is extended in the lateral direction of the paper web W, and its ends are rotatably supported by eccentric sleeves 3*a* and 3*b* through bearings 1*i* and 1*i* (one side is not shown).

Figure 6:
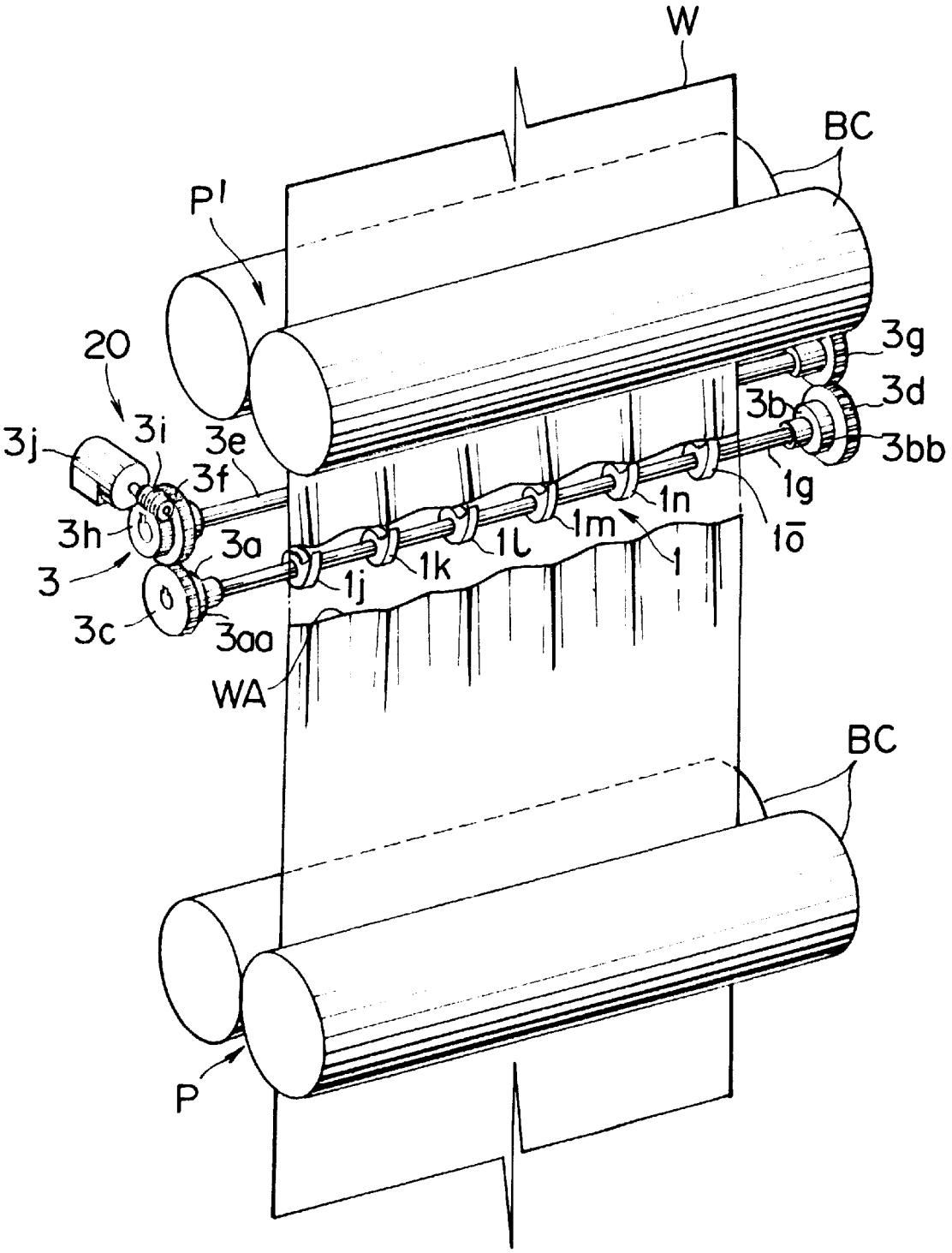
FIG. 6 is a schematically perspective view showing the fifth embodiment of a web width adjusting device according to the present invention.

In FIG. 6, the pressure force applying means 1 of the fifth embodiment includes a plurality of cam-shaped members 1*j*, 1*k*, 1*l*, 1*m*, 1*n* and 1*o* which are separated from each other at a regular interval and fixedly assembled on a shaft 1*g* in the same manner as the first embodiment. Each of the cam-shaped members has a smooth surface which is brought into contact with the wave surface in the predetermined same posture.

Figure 7:
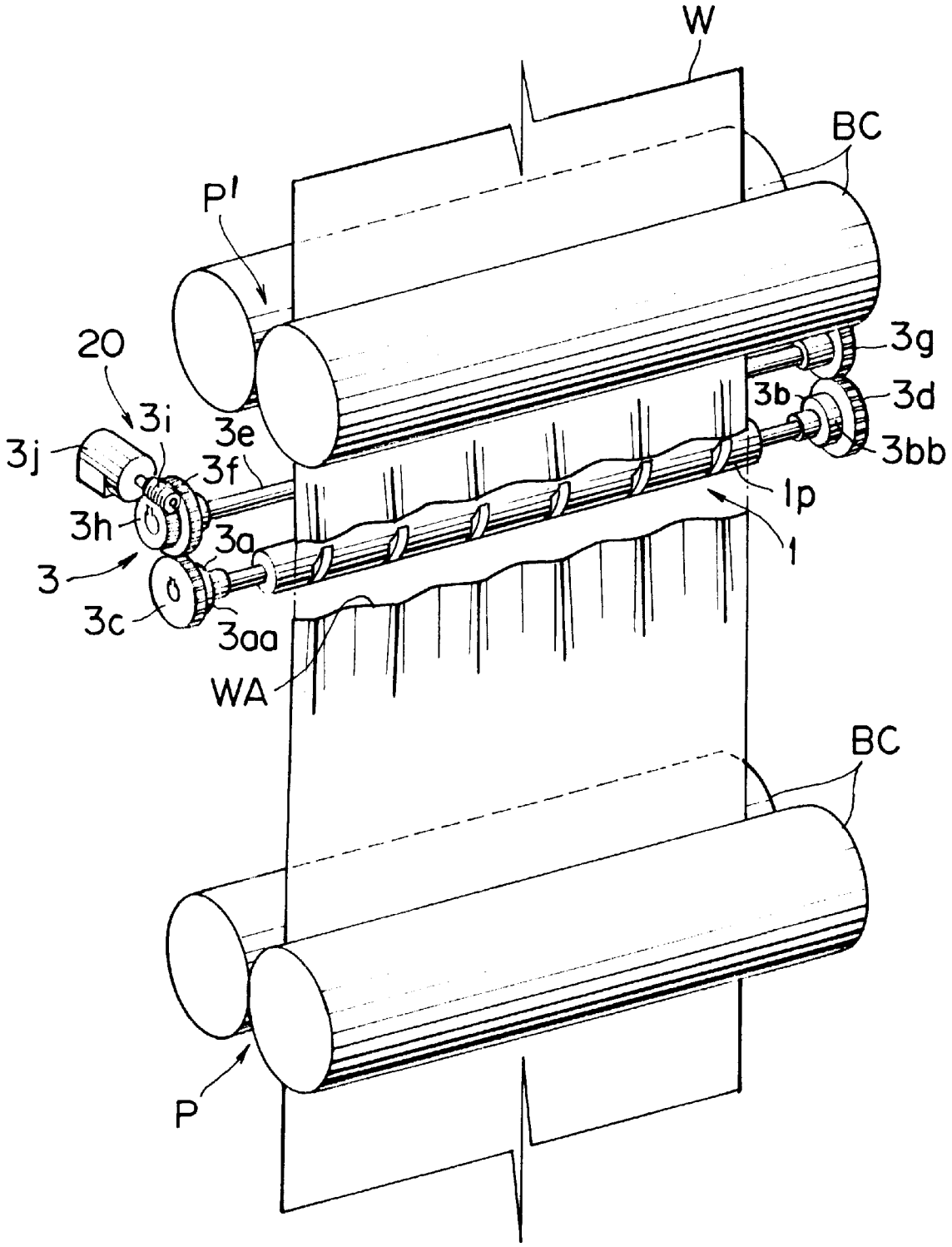
FIG. 7 is a schematically perspective view showing the sixth embodiment of a web width adjusting device according to the present invention.

In FIG. 7, the pressure force applying means 1 of the sixth embodiment includes a contact shaft 1*p* with a plurality of partial convex sections with smooth surfaces. This contact shaft 1*p* is extended in the lateral direction of the paper web W, and its ends are rotatably supported by sleeves 3*a* and 3*b*.

Figure 8:
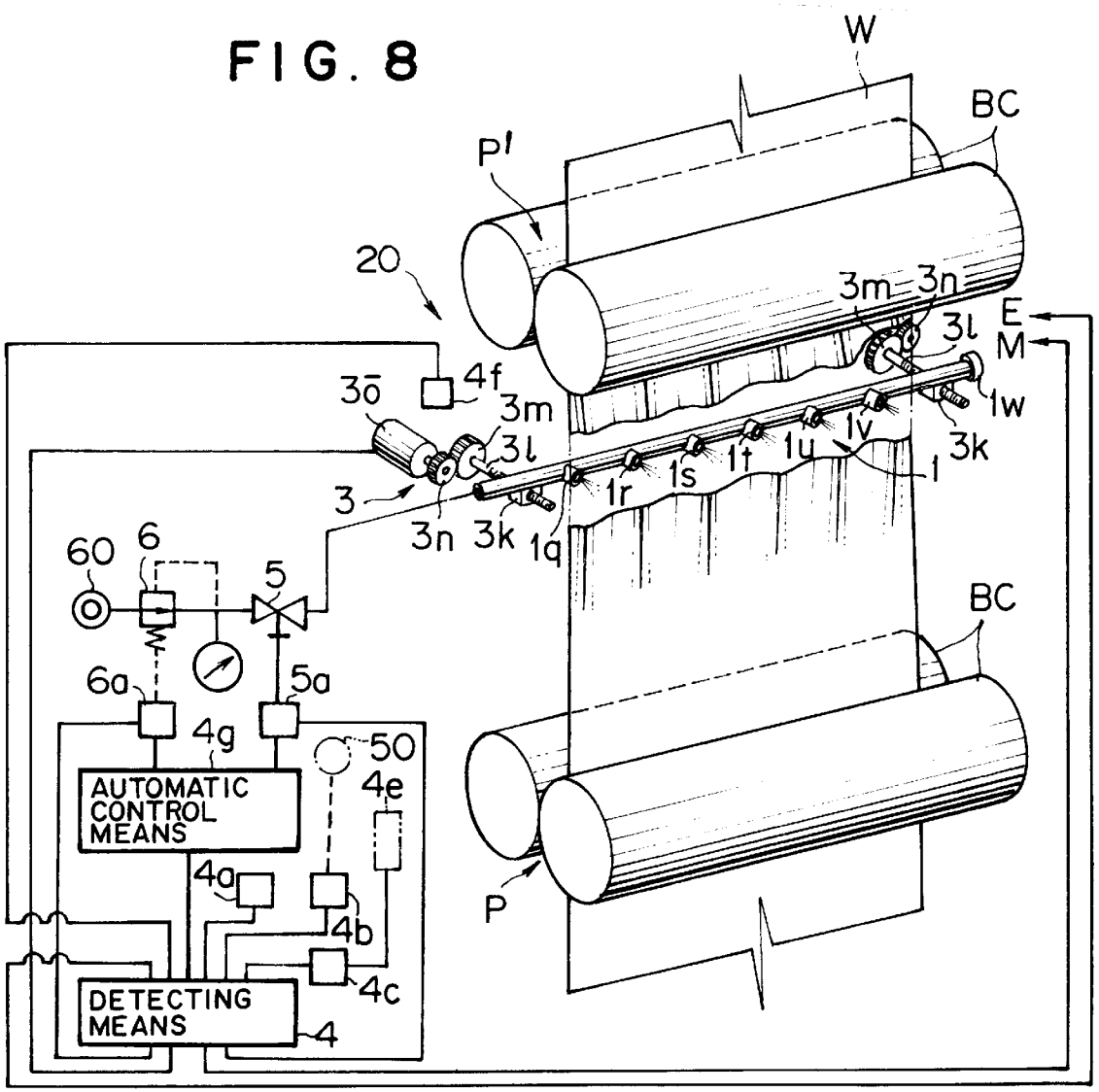
FIG. 8 is a schematically perspective view showing the seventh embodiment of a web width adjusting device according to the present invention.

FIG. 8 shows the pressure force applying means 1 of the seventh embodiment which uses a fluid ejecting system. In this embodiment, the fluid to be used is compressed air. The pressure force applying means 1 includes a fluid feeding pipe 1*w* which is extended in the lateral direction of the paper web W and whose one end is closed. Further, the fluid feeding pipe 1*w* includes a series of fluid ejectors 1*q*, 1*r*, 1*s*, 1*t*, 1*u* and 1*v* which are separated from each other at a regular interval on the pipe 1*w*.

Both ends of the fluid feeding pipe 1*w* are mechanically connected to a primary driving unit 3 for shifting the fluid ejectors 1*q*, 1*r*, 1*s*, 1*t*, 1*u* and 1*v* towards and away from the paper web W. The open end of the pipe 1*w* is communicated with a fluid source 60 via a fluid conduit provided with a fluid amount regulator 5 such as a valve and a pressure control unit 6 for controlling the ejecting pressure of the fluid.

In this embodiment, the primary shifting means 3 includes female screw members 3*k* and 3*k* fixed on the fluid feeding pipe 1*w* near both ends, and male screw members 31 and 31 engaging with the female screw members 3*k*, 3*k*. The male screw member 31 is further fixed with a gear wheel 3*m* which is engaged with a driving gear 3*n*. The driving gear 3*n* is driven by a motor 3*o* not shown in FIG. 8.

The motor 3*o* is controlled by a control means 4 which is electrically operated by an input means 4*a*, such as a key board, and a primary detecting means 4*b* for various operation information such as speed of a main motor 50 representing the traveling speed of the paper web W. The control means 4 is also electrically connected to a second detecting means 4*c* for detecting shears in the printed pattern on the paper web W; for example, the difference between shearing degree at the center region of the paper web and that at the side ends of the web W. and a third detecting means 4*f* for detecting the distance between the fluid ejectors 1*q* to 1*v* and the paper web W; for example, the number of rotations of the male screw member 31, and a fourth detecting means 4*g* for detecting the fluid pressure and ejecting rate of the fluid ejected by the fluid ejectors 1*q* to 1*v*, for example, the regulation rate of the valve 5 and the regulator 6. Further the control means 4 is connected to the motor 3*o* and automatic control units 5*a* and 6*a* for the valve 5 and the regulator 6. The detecting means 4*c* includes a sensing element 4*e*. On the other hand, the control means 4 is electrically connected to another motor 3*o* through a line M and to another detecting means 4*f* for detecting the distance between the fluid ejectors 1*q* to 1*v* and the paper web W through a line E.

Although FIG. 8 shows that the control means 4 is communicated with only the primary shifting means 3, the fluid amount regulator 5 and the pressure control unit 6 belong to one width adjusting device, the control means 4 is electrically connected to the similar means and members belonging to the other web width adjusting devices to perform the width adjusting operation in the whole printing system shown in FIG. 1.

Alternatively, the control means 4 may be communicated with these detecting means and driving means by any conventional radio means.

FIG. 9 to FIG. 19 show the eighth to eighteenth embodiments of the present invention, which employ a counter pressure applying means in addition to the pressure force applying means of the width adjusting device. The counter pressure applying means is represented by a numeral 2 which may be altered in various configurations to apply the counter pressure onto the other side surface is applied with the pressure by the pressure force applying means 1 as shown in FIG. 9 to FIG. 19.

Figure 9:
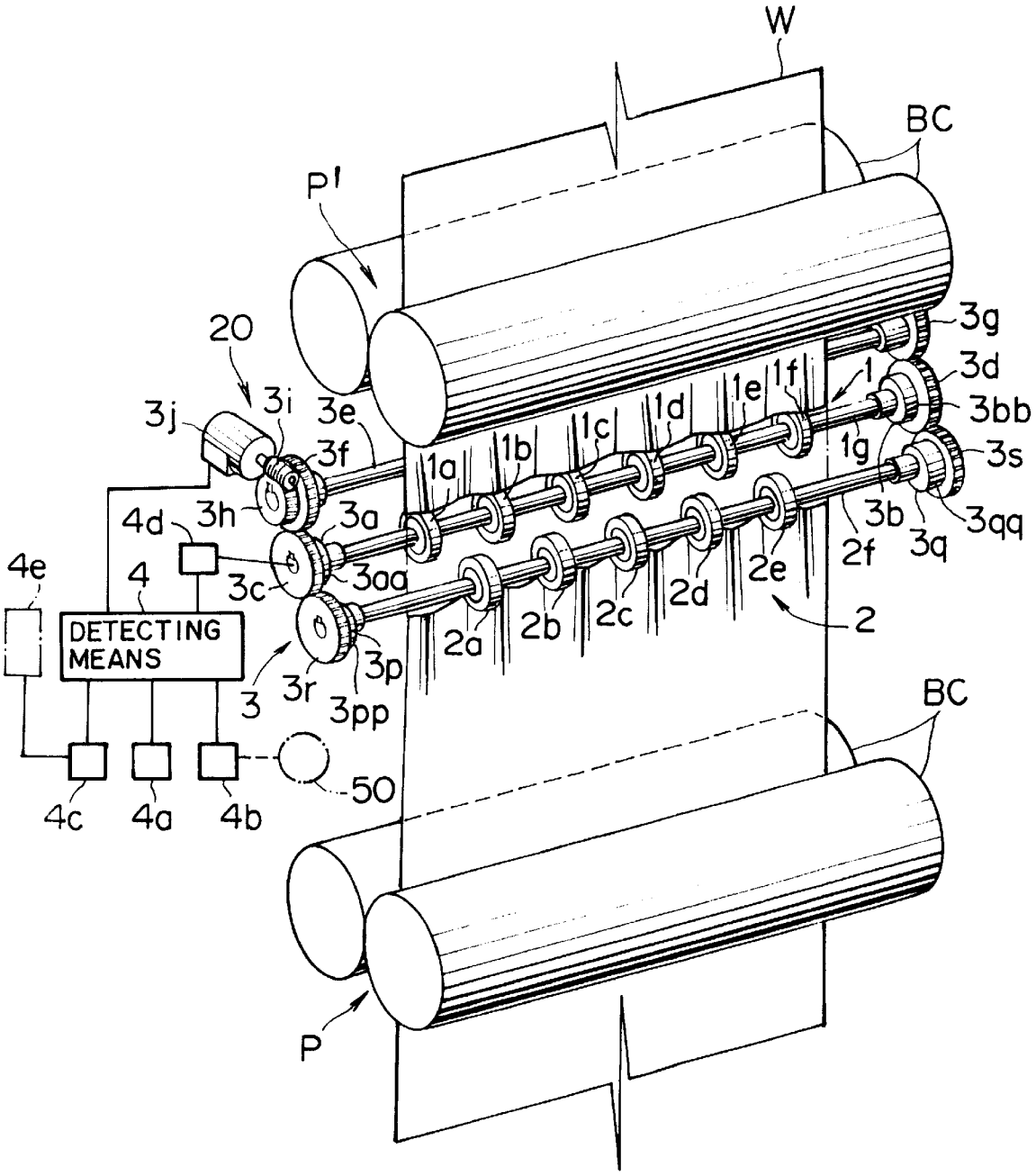
FIG. 9 is a schematically perspective view showing the eighth embodiment of a web width adjusting device according to the present invention.

FIG. 9 shows the eighth embodiment wherein a counter pressure applying means 2 is added to the structure of the web width adjusting device shown in FIG. 2. This counter pressure applying means 2 includes a shaft 2*f* extended parallel to the shaft 1*g* of the pressure force applying means 1 and positioned upstream of the paper web traveling direction, slightly lower than the shaft 1*g* in FIG. 9. On the shaft 2*f* a plurality of contact rollers 2*a*, 2*b*, 2*c*, 2*d*, and 2*e* are separated from each other at a regular interval and rotatably assembled thereon. It is noted that the contact rollers 2*a*, 2*b*, 2*c*, 2*d*, and 2*e* are shifted with respect to the contact rollers 1*a*, 1*b*, 1*c*, 1*d* and 1*e* on the shaft 1*g* in the lateral direction of the paper web W.

The shaft 2*f* is eccentrically supported at its ends by eccentric sleeves 3*p* and 3*q* which are rotatably mounted on a frame, not shown, through end members 3*pp* and 3*qq*. The shaft 2*f* is integrally rotated with the eccentric sleeves 3*p* and 3*q*. Further the shaft 2*f* is mechanically connected to a primary shifting means 3 through gears 3*r* and 3*s* meshed with gears 3*c* and 3*d*, respectively. Thus the counter pressure applying means 2 can be moved towards and away from the paper web W in accordance with the movement of the shifting means 3.

The other members are configured in the same manner as the first embodiment shown in FIG. 2. Although FIG. 9 shows the counter pressure applying means 2 is positioned in upstream of the paper web traveling direction with respect to the pressure applying means 1, the counter pressure applying means 2 is not limited to this upstream position. The counter pressure applying means 2 may be positioned downstream or opposite to the pressure applying means 1. Alternatively, the counter pressure applying means 2 may be isolated from the above described shifting means 3, and activated by an additional shifting means; i.e. a second shifting means, not shown, having the same mechanism as shown in FIG. 2. The second shifting means may be controlled by the control means 4 in synchronism with the first shifting means or an additional control means, not shown, electrically communicated with the control means 4.

FIG. 10 to FIG. 14 show the ninth to thirteenth embodiments of the present invention, which employ various configurations of the pressure force applying means 1 and the counter pressure applying means 2 of the width adjusting device. In these drawings, the control means 4 and the driving and detecting means which are associated to the control means 4 are not shown because these mechanisms are configured essentially the same as the eighth embodiment.

Figure 10:
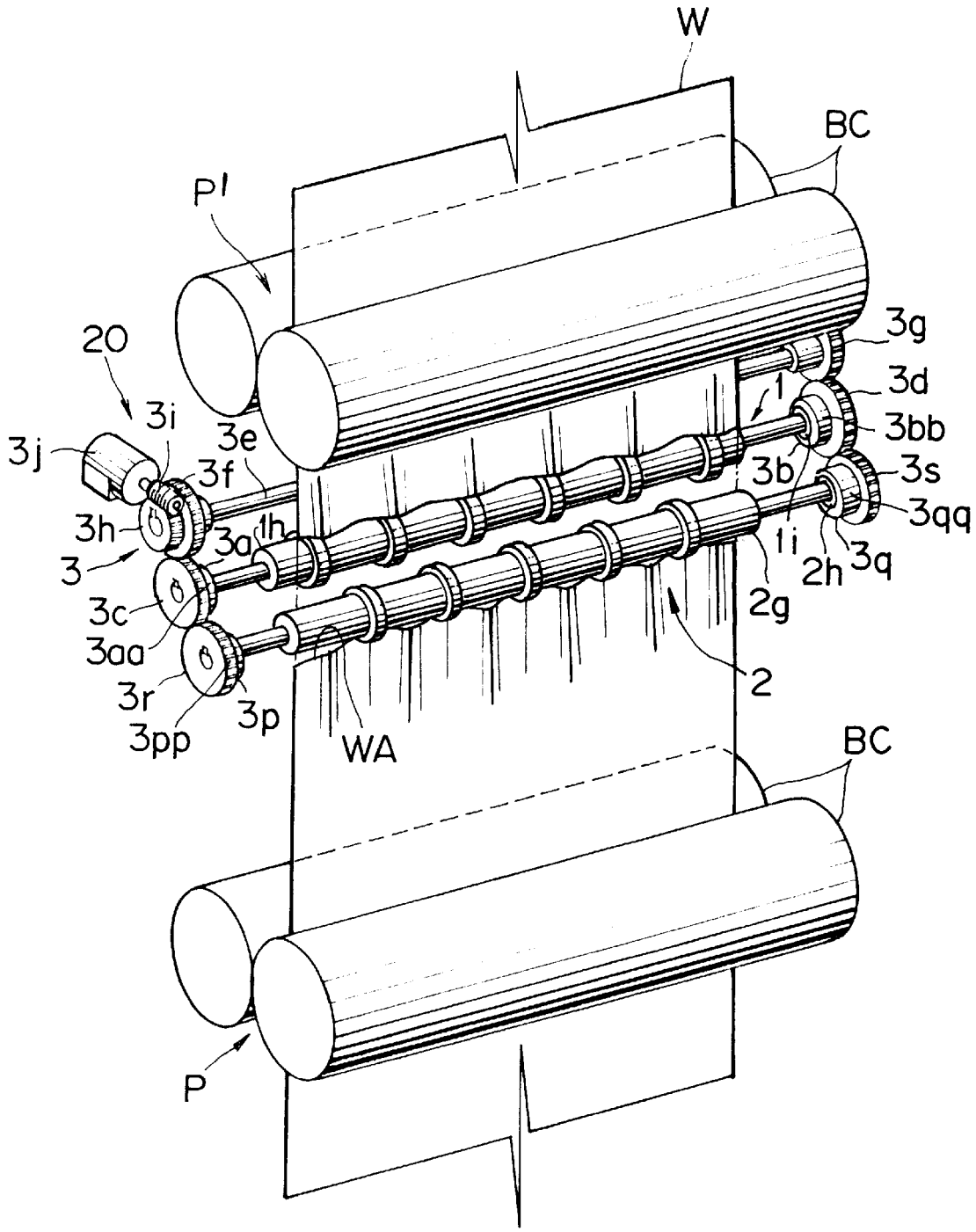
FIG. 10 is a schematically perspective view showing the ninth embodiment of a web width adjusting device according to the present invention.

The width adjusting device shown in FIG. 10 includes a pressure force applying means 1 including a contact shaft 1*h* with a plurality of convex sections. This contact shaft 1*h* is extended in the lateral direction of the paper web W, and its ends are rotatably supported by eccentric sleeves 3*a* and 3*b* through bearings 1*i* and 1*i* (one side is not shown).

In FIG. 10, a counter pressure applying means 2 includes a shaft 2*g* extended parallel to the shaft 1*h* of the pressure force applying means 1 and positioned upstream of the paper web traveling direction, slightly lower than the shaft 1*h* in the drawing. A plurality of contact rollers formed on the shaft 2*g* are shifted with respect to the contact rollers on the shaft 1*h* in the lateral direction of the paper web W. The shaft 2*g* is eccentrically supported at its ends by eccentric sleeves 3*p* and 3*q* through bearings 2*h*, and 2*h* (one is not shown). The other members are constituted in substantially the same manner as the eighth embodiment shown in FIG. 9.

Figure 11:
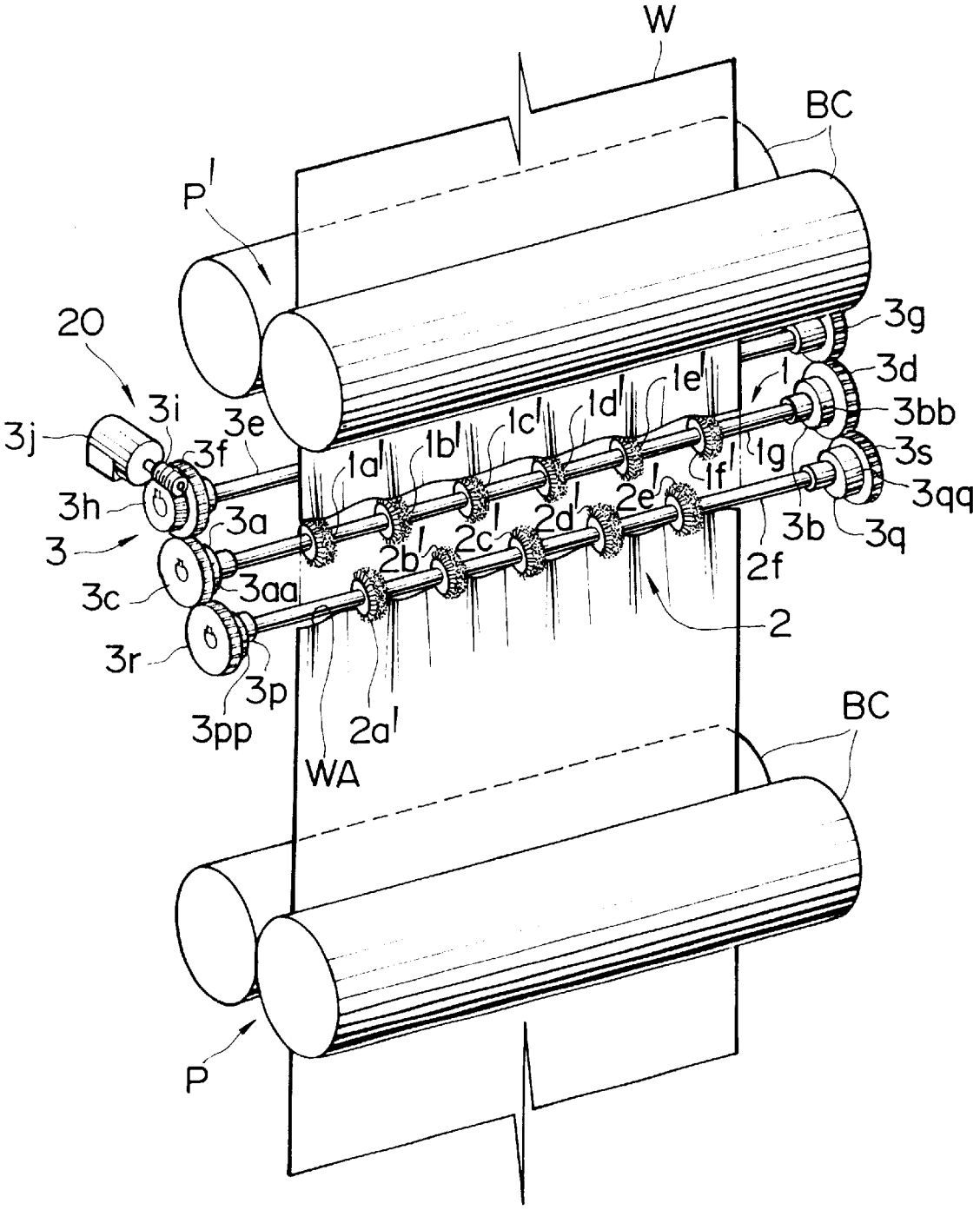
FIG. 11 is a schematically perspective view showing the tenth embodiment of a web width adjusting device according to the present invention.

In FIG. 11, a pressure force applying means 1 of the tenth embodiment includes a plurality of brush rollers 1*a*', 1*b*', 1*c*', 1*d*', 1*e*' and 1*f*' which are separated from each other at a regular interval and rotatably assembled on a shaft 1*g*. A counter pressure applying means 2 of this embodiment includes a shaft 2*f* extended parallel to the shaft 1*g* of the pressure force applying means 1 and positioned upstream of the paper web traveling direction, slightly lower than the shaft 1*g* in the drawing. A plurality of brush rollers 2*a*' to 2*f*' rotatably mounted on the shaft 2*f* are shifted with respect to the brush rollers 1*a*' to 1*f*' on the shaft 1*g* in the lateral direction of the paper web W.

Figure 12:
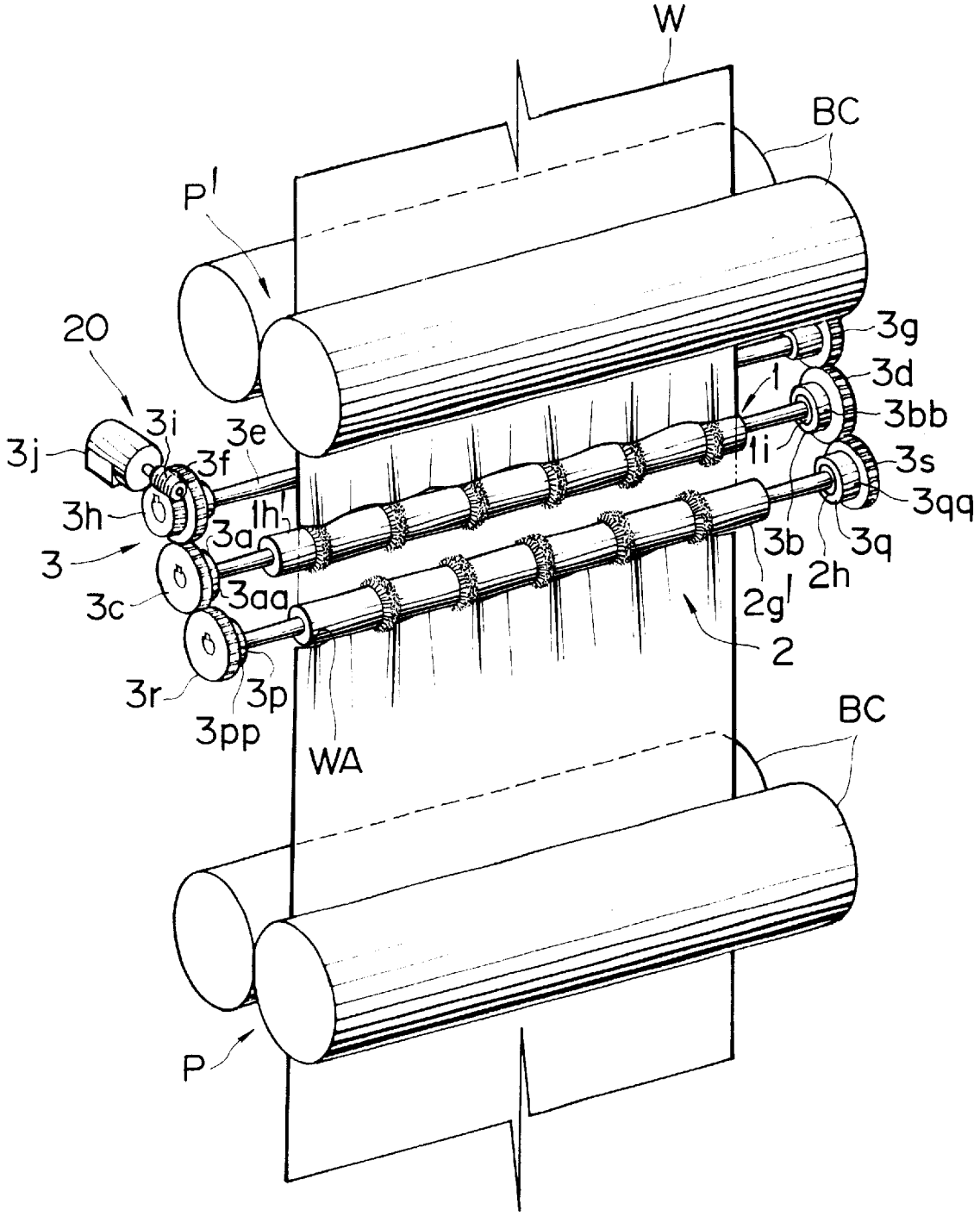
FIG. 12 is a schematically perspective view showing the eleventh embodiment of a web width adjusting device according to the present invention.

In FIG. 12, a pressure force applying means 1 of the eleventh embodiment includes a contact shaft 1*h*' with a plurality of brush convex sections. This contact shaft 1*h*' is extended in the lateral direction of the paper web W, and its ends are rotatably supported by eccentric sleeves 3*a* and 3*b* through bearings 1*i* and 1*i* (one side is not shown). A counter pressure applying means 2 of this embodiment includes a shaft 2*g*' extended parallel to the shaft 1*h*' of the pressure force applying means 1 and positioned upstream of the paper web traveling direction, slightly lower than the shaft 1*h*' in the drawing. A plurality of brush convex sections on the shaft 2*g*' are shifted with respect to the brush convex sections on the shaft 1*h*' in the lateral direction of the paper web W so that each of the brush convex sections of the shaft 2*g*' is positioned between two of the brush convex sections of the shaft 1*h*'. Both ends of the shaft 2*g*' are rotatably supported by eccentric sleeves 3*p* and 3*q* through bearings 2*h* and 2*h* (one side is not shown). The other members are constitued in substantially the same manner as the eighth embodiment shown in FIG. 9.

Figure 13:
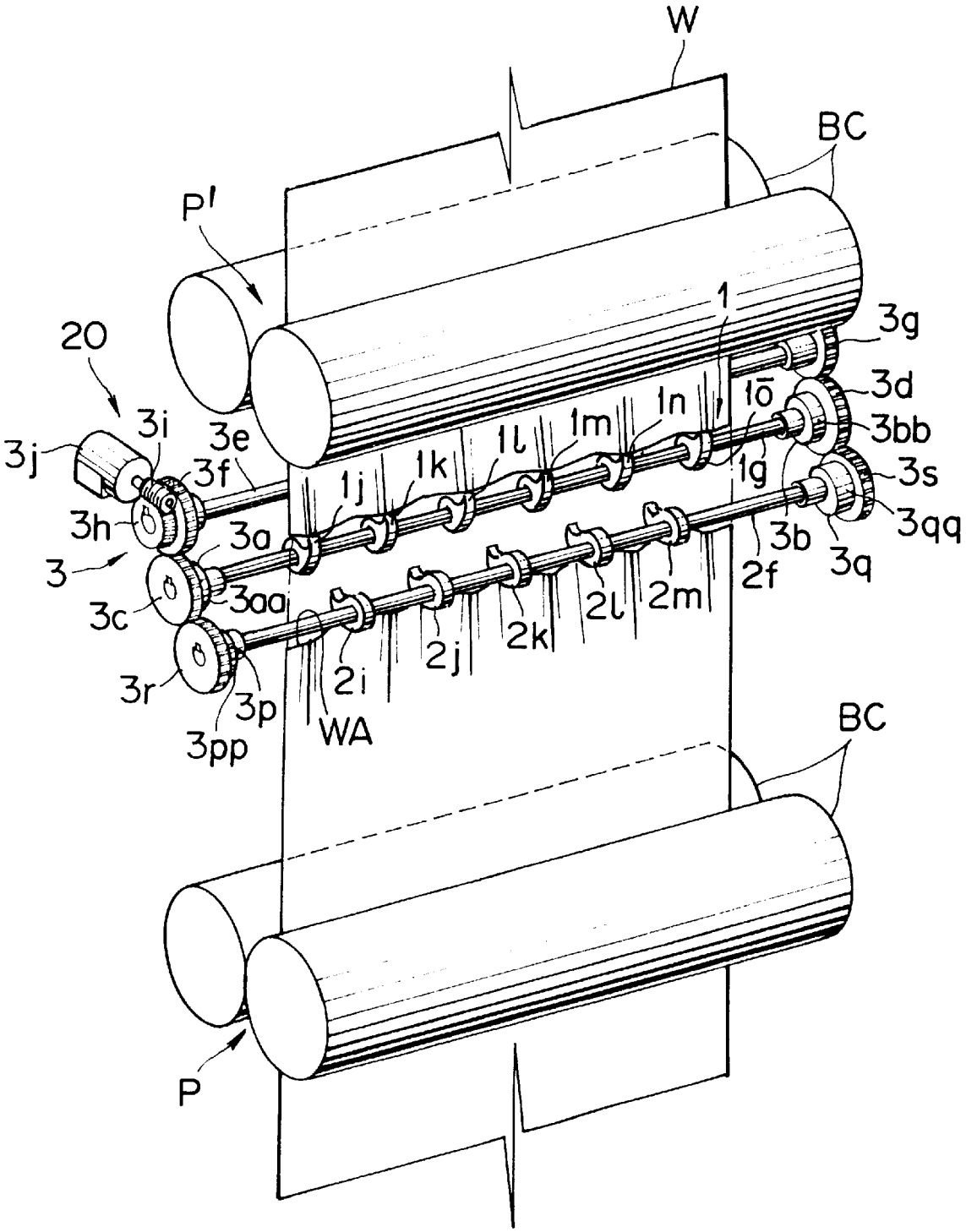
FIG. 13 is a schematically perspective view showing the twelfth embodiment of a web width adjusting device according to the present invention.

In FIG. 13, a pressure force applying means 1 of the twelfth embodimet includes a plurality of cam-shaped members 1*j*, 1*k*, 1*l*, 1*m*, 1*n* and l*o* which are separated from each other at a regular interval and rotatably assembled on a shaft 1*g* in the same manner as the first embodiment. Each of the cam-shaped members has a smooth surface which is brought into contact with the wave surface in the predetermined same posture. A counter pressure applying means 2 of this embodiement includes a shaft 2*f* extended parallel to the shaft 1*g* of the pressure force applying means 1 and positioned upstream of the paper web traveling direction, slightly lower than the shaft 1*g* in the drawing. A plurality of cam-shaped members 2*i*, 2*j*, 2*k*, 2*l* and 2*m* mounted on the shaft 2*f* are shifted with respect to the cam-shaped members on the shaft 1*g* in the lateral direction of the paper web W so that each of the cam-shaped members of the shaft 2*f* is positioned between two of the cam-shaped members of the shaft 1*g*. The other members are constituted in substantially the same manner as the eighth embodiment shown in FIG. 9.

Figure 14:
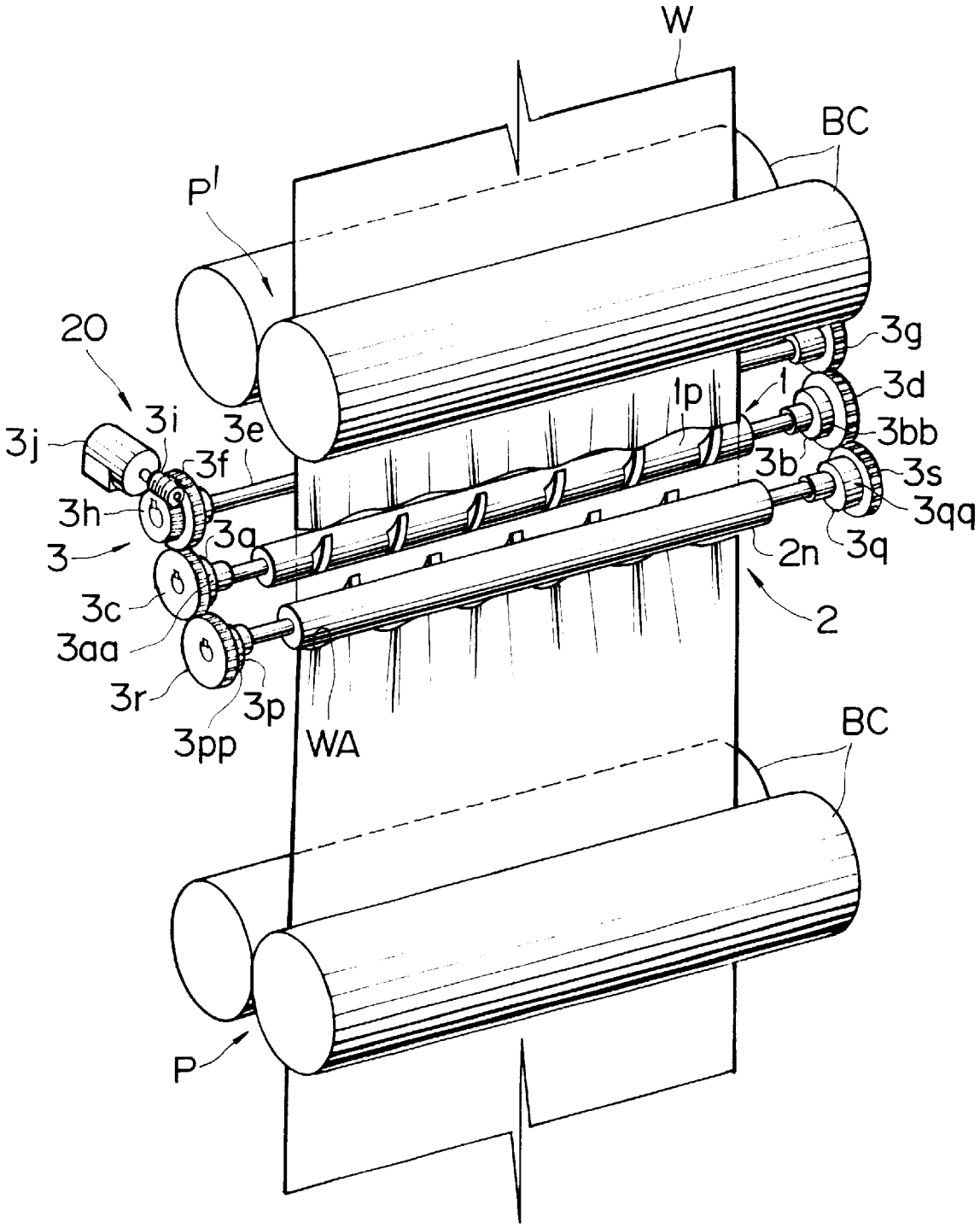
FIG. 14 is a schematically perspective view showing the thirteenth embodiment of a web width adjusting device according to the present invention.

In FIG. 14, a pressure force applying means 1 of the thirteenth embodiment includes a contact shaft 1*p* with a plurality of convex sections with smooth surfaces. This contact shaft 1*p* is extended in the lateral direction of the paper web W, and its ends are rotatably supported by eccentric sleeves 3*a* and 3*b*. A counter pressrue applying means 2 of this embodiment includes another contact shaft 2*n* extended parallel to the shaft 1*p* of the pressure force applying means 1 and positioned upstream of the paper web traveling direction, slightly lower than the shaft 1*p* in the drawing. A plurality of convex sections of the shaft 2*n* are shifted with respect to the convex sections of the shaft 1*p* in the lateral direction of the paper web W so that each of the convex sections of the shaft 2*n* is positioned between two of the convex sections of the shaft 1*p*. The other members are constituted in substantially the same menner as the eighth embodiment shown in FIG. 9.

Figure 15:
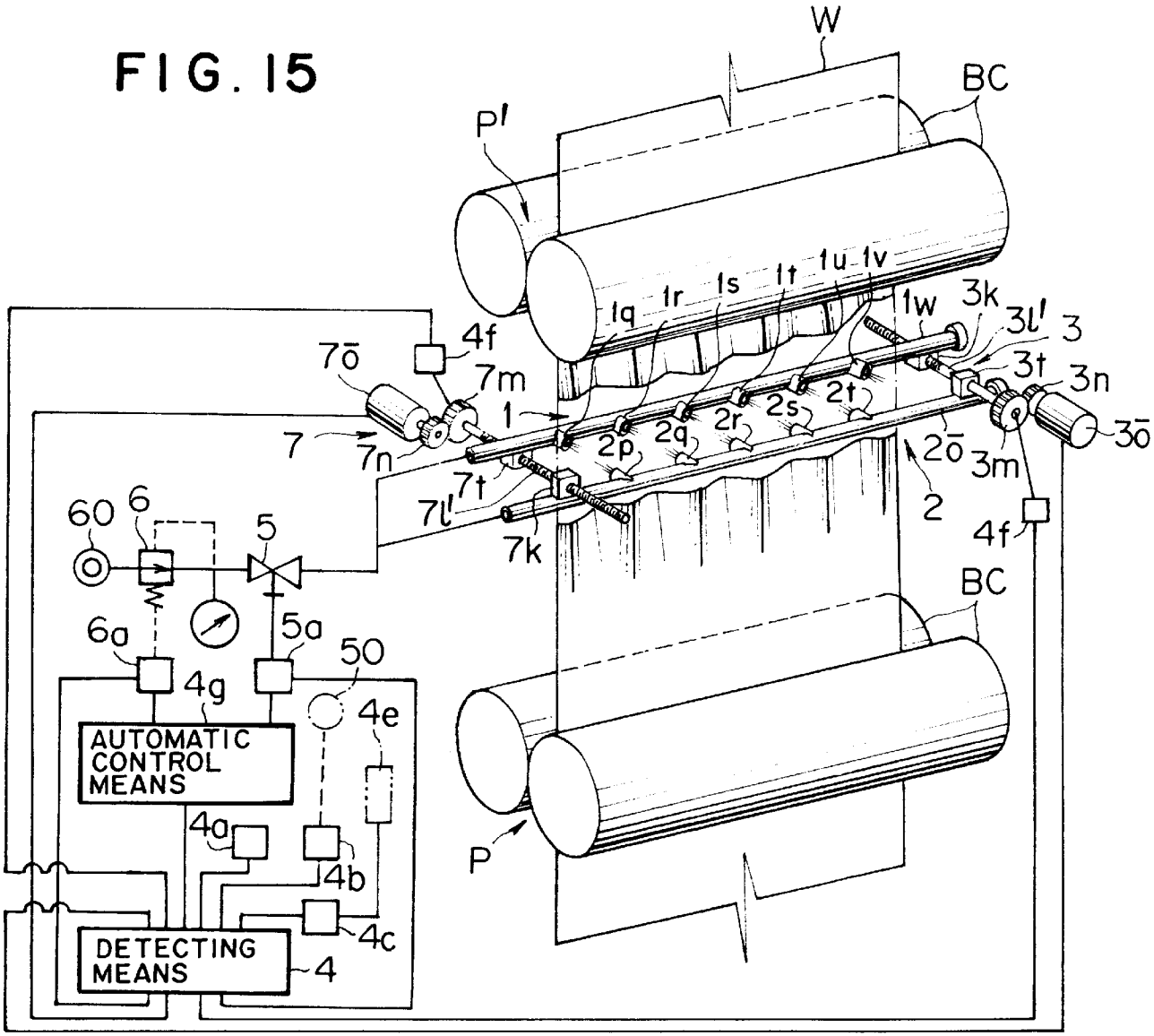
FIG. 15 is a schematically perspective view showing the fourteenth embodiment of a web width adjusting device according to the present invention.

FIG. 15 shows a counter pressure applying means 2 which uses a fluid ejecting system in addition to the pressure force applying means 1 of the seventh embodiment shown in FIG. 8. Further, one activating means of the first shifting means shown in FIG. 8 is mechanically connected to a fluid feeding pipe for the counter pressure applying means 2 to make a second shifting means 7.

In this embodiment, the pressure force applying means 1 includes a fluid feeding pipe 1*w* which is extended in the lateral direction of the paper web W and whose one end is closed. Further, the fluid feeding pipe 1*w* includes a series of fluid ejectors 1*q*, 1*r*, 1*s*, 1*t*, 1*u* and 1*v* which are separated from each other at a regular interval on the pipe 1*w* in the same manner as shown in FIG. 8. One end of the fluid feeding pipe 1*w* is mechanically connected to a first driving unit 3 for shifting the fluid ejectors 1*q*, 1*r*, 1*s*, 1*t*, 1*u* and 1*v* towards and away from the paper web W. The other end of the fluid feeding pipe 1*w* is linked with the second shifting means 7 so that the fluid feeding pipe 1*w* is activated in synchronism with the second shifting means 7.

A counter pressure applying means 2 of this embodiment includes a fluid feeding pipe 2*o* extended parallel to the pipe 1*w* of the pressure force applying means 1 and positioned upstream of the paper web traveling direction, slightly lower than the shaft 1*w* in the drawing. A plurality of fluid ejectors 2*p*, 2*q*, 2*r*, 2*s*, and 2*t* formed on the pipe 2*o* are shifted with respect to the fluid ejectors 1*q* to 1*v* of the pipe 1*w* in the width direction of the paper web W.

One end of the pipe 2*o* is closed and mechanically connected to the second shifting means 7 to move the fluid ejectors 2*p*, 2*q*, 2*r*, 2*s*, and 2*t* formed on the pipe 20 towards and away from the paper web W. The other end of the fluid feeding pipe 2*o* is linked with the first shifting means 3 so that the fluid feeding pipe 2*o* is activated in synchronism with the first shifting means 3.

The open ends of the pipes 1*w* and 2*o* are communicated with a fluid source 60 via a fluid conduit provided with a fluid amount regulator 5 such as a valve and a pressure control unit 6 for controlling the ejecting pressure of the fluid.

In this embodiment shown in FIG. 15, the pressure and amount of the fluid supplied to the fluid feeding pipes 1*w* and 2*o* are simultaneously controlled by the same control system including a single valve 5 and a single regulator 6. As a modification of this embodiment, the fluid supplied to the pipe 1*w* of the pressure force applying means 1 and the pipe 2*o* of the counter pressure applying means 3 are independently controlled through two sets of control means which belong to respective fluid feeding lines.

In this embodiment, the first shifting means 3 includes a female screw member 3*k* fixed on the fluid feeding pipe 1*w* near one end, and a male screw member 31' engaging with the female screw member 3*k*. The male screw member 31' has a non-screw section on which a sliding member 3*t* that is also fixed. to the closed end of the fluid feeding pipe 2*o* of the counter pressure applying means engaged. The male screw member 31' is also fixed with a gear wheel 3*m* which is engaged with a driving gear 3*n*. The driving gear 3*n* is driven by a motor 3*o*. The second shifting means 7 inlcudes a female screw member 7*k* fixed on the fluid feeding pipe 2*o* near one end, and a male screw member 71' engaging with the female screw member 7*k*. The male screw member 71' has a non-screw section on which a sliding member 7*t* that is also fixed to the closed end of the fluid feeding pipe 1*w* of the pressure applying means is engaged. The male screw member 71' is further fixed with a gear wheel 7*m* which is engaged with a driving gear 7*n*. The driving gear 7*n* is driven by a motor 7*o*.

In this embodiment, the motors 3*o* and 7*o* are controlled by a control means 4 which is elecrtrically operated by an input means 4*a*, such as a key board and a detecting means 4*b* for various operation information such as speed of a main motor 50 representing the traveling speed of the paper web W. The control means 4 is further electrically connected to a second detecting means 4*c* for detecting shears in the printed pattern on the paper web W; for example, the difference between shearing degree at the center region of the paper web and that at the side ends of the web W, and a third detecting means 4*f* for detecting the distance between the fluid ejectors 1*q* to 1*v* and the paper web W; for example, the number of rotations of the male screw member 31, and a fourth detecting means 4*g* for detecting the fluid pressure and ejecting rate of the fluid ejected by the fluid ejectors 1*q* to 1*v*, and 2*p* to 2*t*, for example, the regulation rate of the valve 5 and the regulator 6. Further, the control means 4 is connected to the motor 3*o* and automatic control units 5*a* and 6*a* for the valve 5 and the regulator 6. The detecting means 4*c* includes a sensing element 4*e*.

Although FIG. 15 shows that the control means 4 is communicated with only the first shifting means 3, the second shifting means 7, the fluid amount regulator 5 and the pressure control unit 6 belong to one width adjusting device, the control means 4 is electrically connected to the similar means and members belonging to the other web width adjusting devices to perform the width adjusting operation in the whole printing system shown in FIG. 1. Additionally, the control means 4 may be communicated with the driving and detecting means through any type of radio communication system (not shown).

The counter pressure applying means 2 may be positioned downstream or upstream of the web traveling direction or opposite to the pressure applying means 1. The first shifting means 3 and the second shifting means 7 may be independently controlled by two different control systems.

Figure 16:
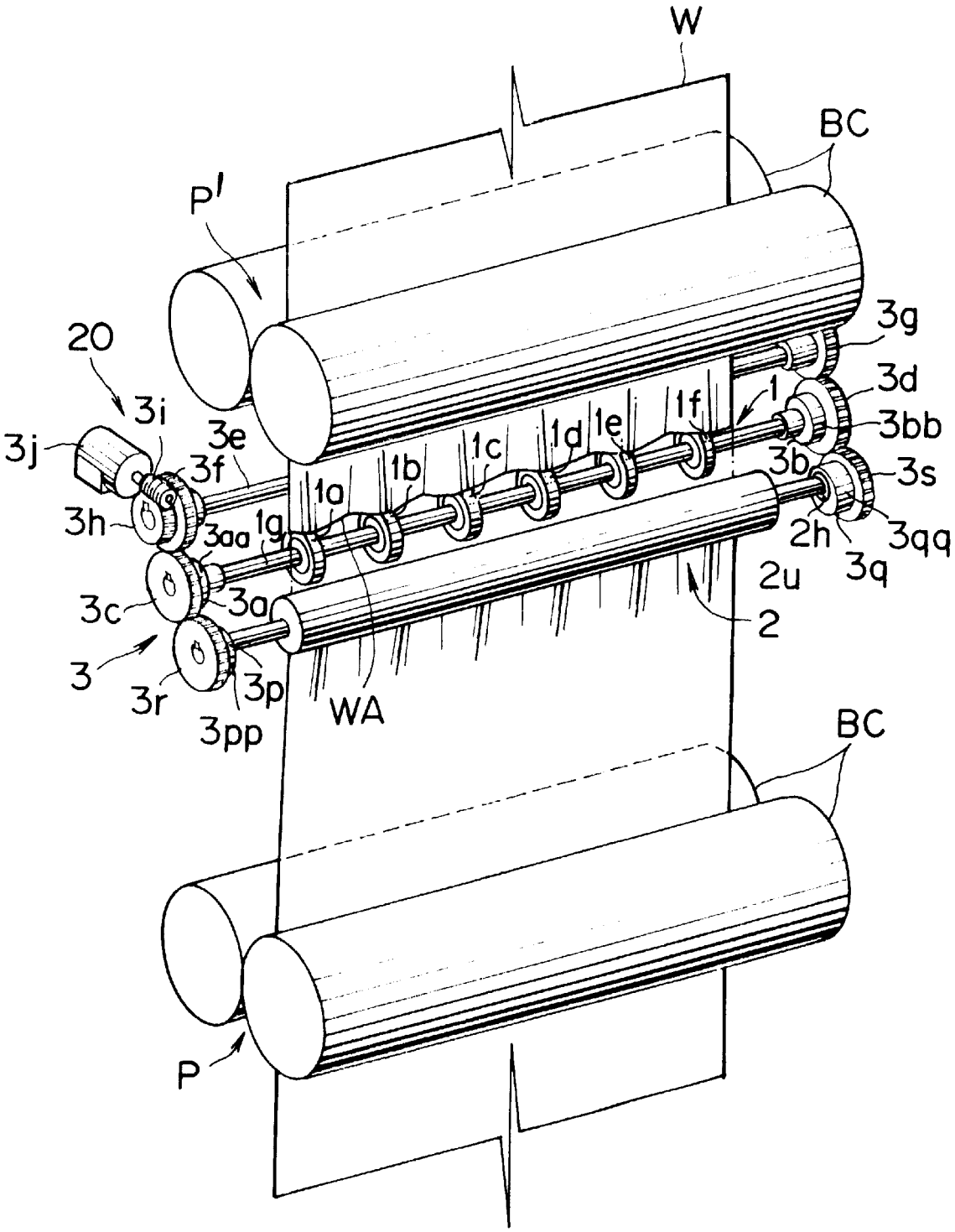
FIG. 16 is a schematically perspective view showing the fifteenth embodiment of a web width adjusting device according to the present invention.
Figure 17:
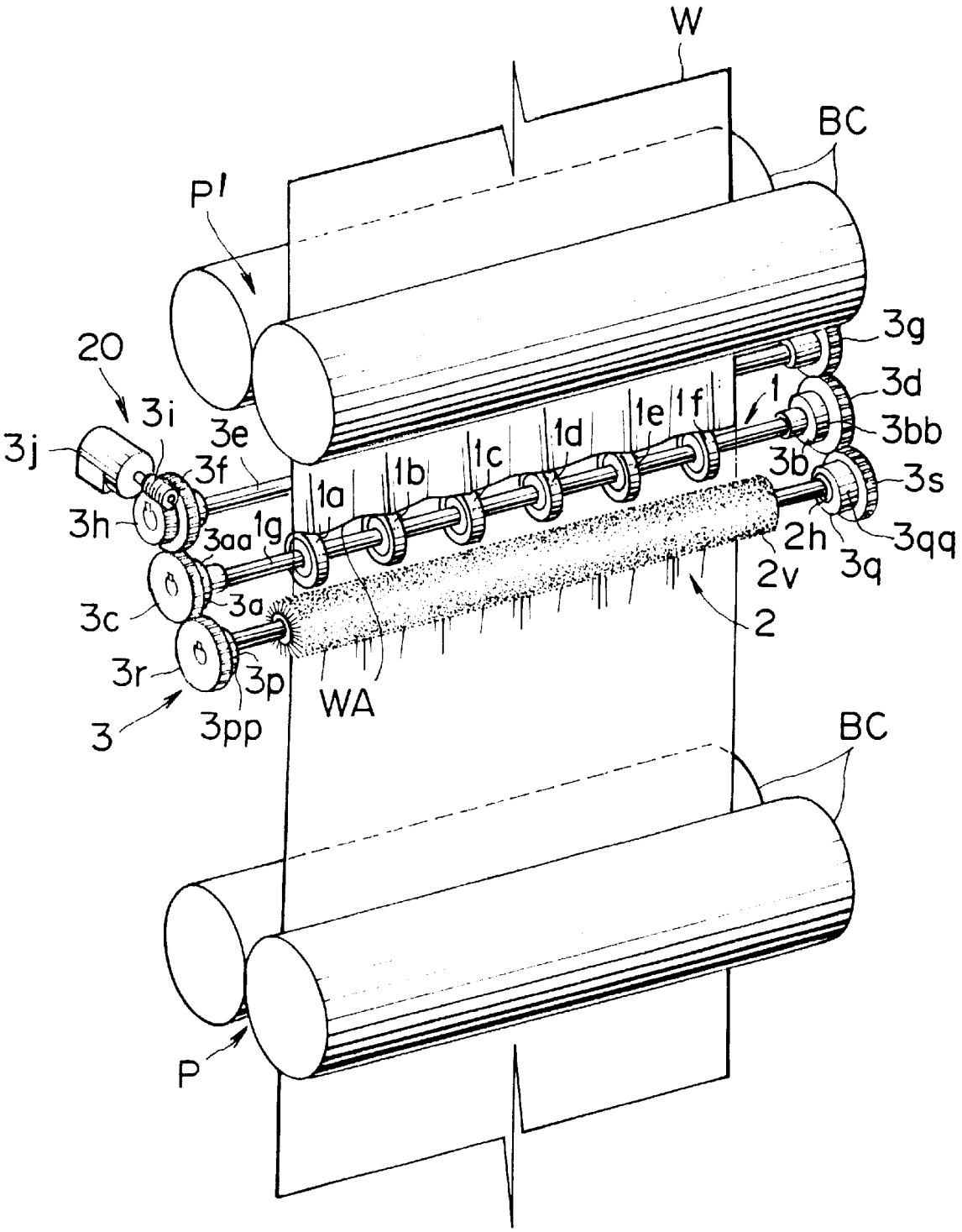
FIG. 17 is a schematically perspective view showing the sixteenth embodiment of a web width adjusting device according to the present invention.
Figure 18:
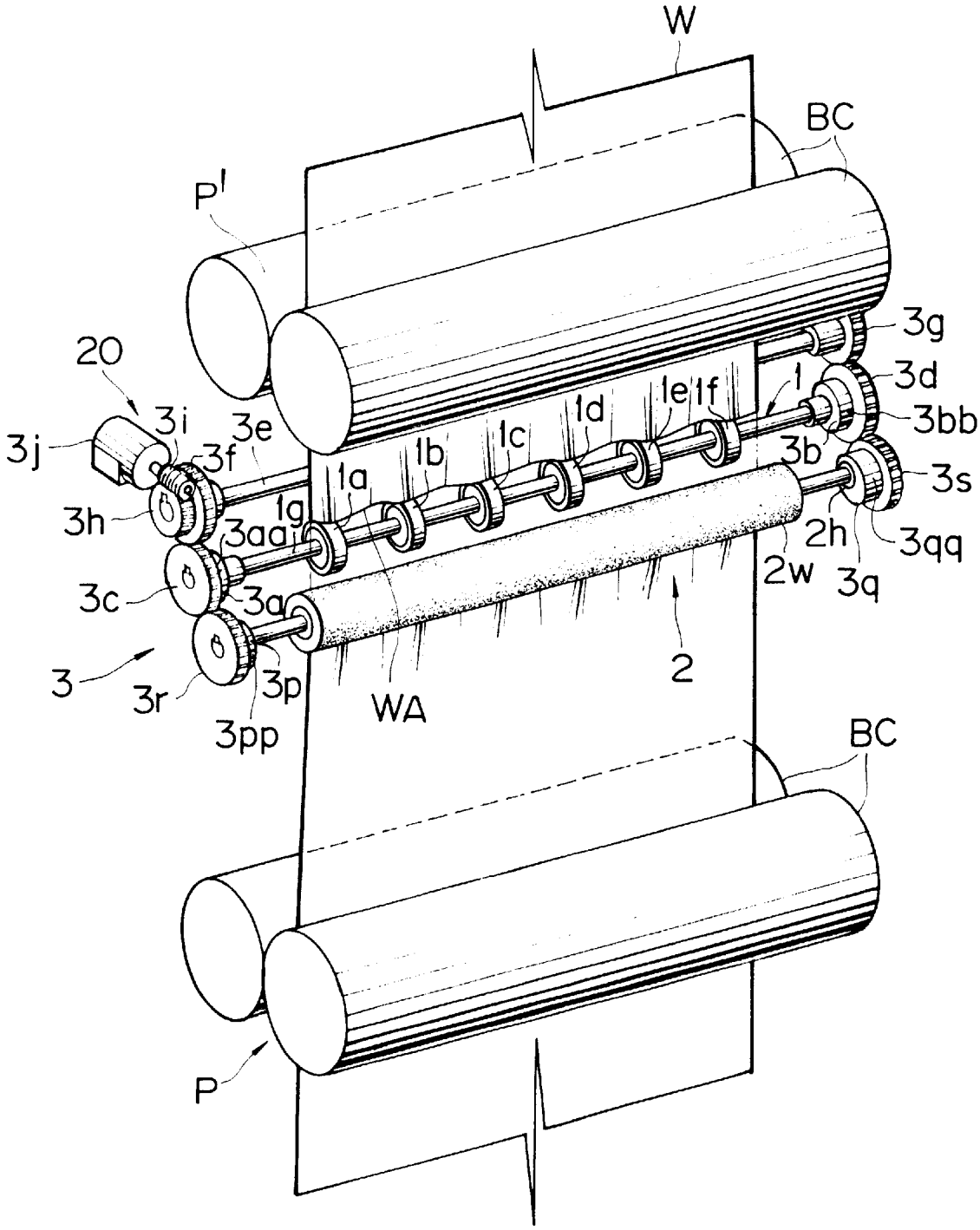
FIG. 18 is a schematically perspective view showing the seventeenth embodiment of a web width adjusting device according to the present invention.

FIG. 16 to FIG. 18 show the fifteenth to seventeenth embodiments of the present invention, which employ various configurations of the counter pressure applying means 2 which employ a contact roller having an elastic contact surface. The pressure force applying means 1, the control systems for the pressure force applying means 1, and the counter pressure applying means 2 are constituted in the same manner as the width adjusting device 20 shown in FIG. 9.

In FIG. 16, the counter pressure applying means 2 employs an air bag roller 2*u* with a flat contact surface.

In FIG. 17, the counter pressure applying means 2 employs a brush roller 2*v* with a continuous brush surface.

In FIG. 18, the counter pressure applying means 2 employs a sponge roller 2*w* with a continuous sponge surface.

In these embodiments, the rollers 2*u*, 2*v* and 2*w* are extended parallel to the shaft 1*g* of the pressure force applying means 1 and positioned upstream of the paper web traveling direction. Their shafts are eccentrically supported at their ends by eccentric sleeves 3*p* and 3*q* through bearings 2*h* and 2*h* (one is not shown) in the same manner as shown in FIG. 9.

Although these embodiments employ the contact rollers 2*u*, 2*v* and 2*w* of elastic materials which are capable of easily deforming and returning, the contact rollers may have hard surfaces not capable of being deformed. In using such hard surface type roller, the contact roller should be positioned upstream or downstream of the paper web traveling direction.

Figure 19:
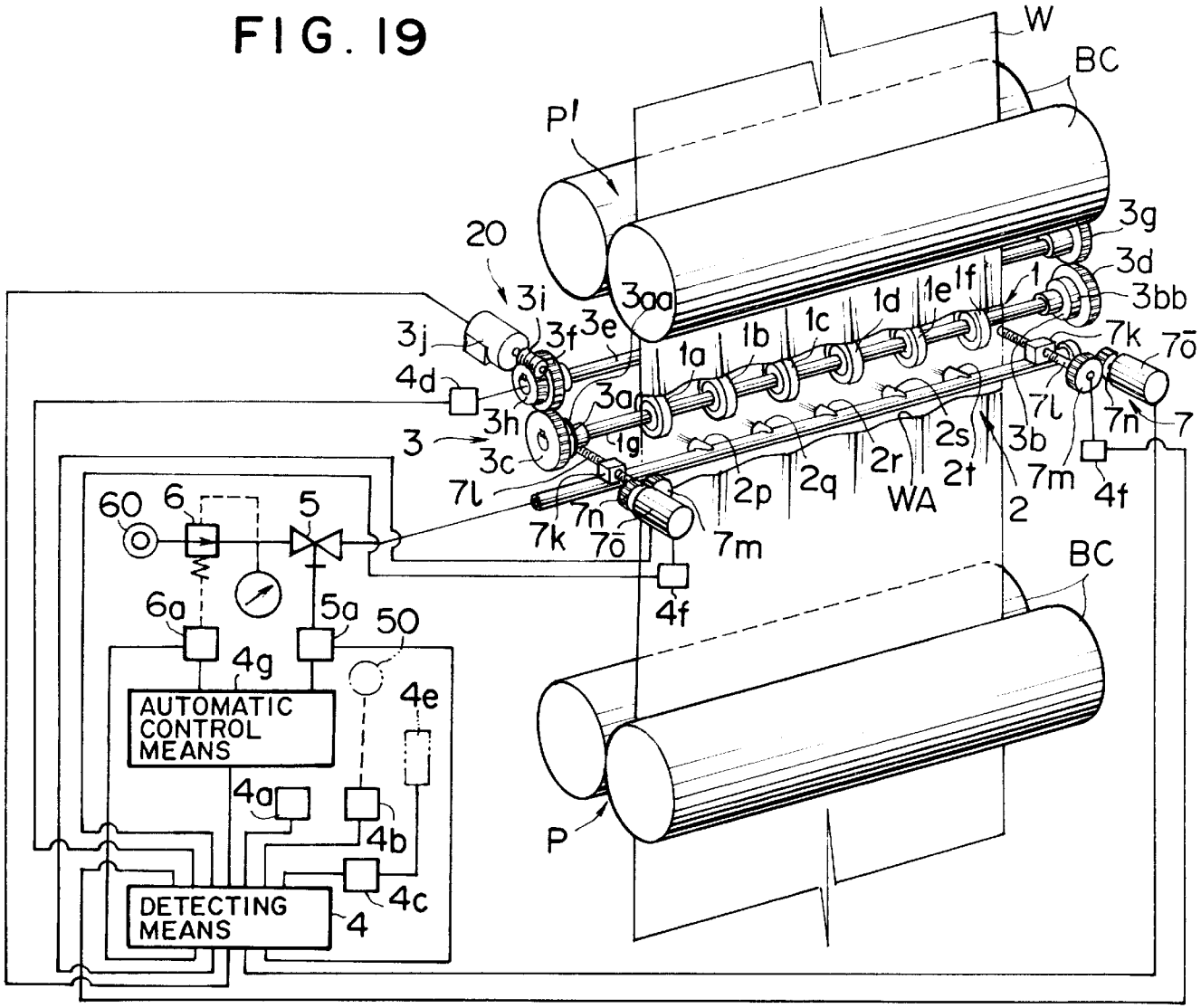
FIG. 19 is a schematically perspective view showing the eighteenth embodiment of a web width adjusting device according to the present invention.

FIG. 19 shows the eighteenth embodiment of the present invention, which employs a fluid feeding pipe as a counter pressure applying means and a plurality of contact rollers as a pressure force applying means as shown in FIG. 2. Further the counter pressure applying means is provided with a second shifting means 7.

The counter pressure applying means 2 of this embodiment includes a fluid feeding pipe 2*o* extended parallel to the pipe 1*g* of the pressure force applying means 1 and positioned upstream of the paper web traveling direction, slightly lower than the shaft 1*w* in the drawing. A plurality of fluid ejectors 2*p*, 2*q*, 2*r*, 2*s*, and 2*t* are formed on the pipe 2*o*. One end of the pipe 2*o* is closed and mechanically connected to the second shifting means 7 to move the fluid ejectors 2*p*, 2*q*, 2*r*, 2*s*, and 2*t* towards and away from the paper web W. The open end of the pipe 2*o* is communicated with a fluid source 60 via a fluid conduit provided with a fluid amount regulator 5 such as a valve and a pressure control unit 6 for controlling the ejecting pressure of the fluid.

In this embodiment, the second shifting means 7 includes a female screw member 7*k* fixed on the fluid feeding pipe 2*o* near one end, and a male screw member 71 engaging with the female screw member 7*k*. The male screw member 71 is further fixed with a gear wheel 7*m* which is engaged with a driving gear 7*n* driven by a motor 7*o*.

In this embodiment, a control means 4 for the shifting means is electrically operated by an input means 4*a* such as a key board and a detecting means 4*b* for various operation information such as speed of a main motor 50 representing the traveling speed of the paper web W. The control means 4 is also electrically connected to a second detecting means 4*c* for detecting shears in the printed pattern on the paper web W; for example, the difference between shearing degree at the center region of the paper web and that at the side ends of the web W, a third detecting means 4*d* for detecting the rotational phase of the eccentric sleeve 3*a*, a fourth detecting means 4*f* for detecting the distance between the fluid ejectors 2*p* to 2*t* and the paper web W; for example, the number of rotations of the male screw member 71, and a fifth detecting means 4*g* for detecting the fluid pressure and ejecting rate of the fluid ejected by the fluid ejectors 2*p* to 2*t*, for example, the regulation rate of the valve 5 and the regulator 6. Further the control means 4 is connected to the motors 3*j* and 7*o* and automatic control units 5*a* and 6*a* for the valve 5 and the regulator 6. The detecting means 4*c* includes a sensing element 4*e*. The other members are constituted in substantially the same manner as the first embodiment shown in FIG. 2.

Although FIG. 19 shows that the control means 4 is communicated with only the first shifting means 3, the second shifting means 7, the fluid amount regulator 5 and the pressure control unit 6 belong to one width adjusting device, the control means 4 is electrically connected to the similar means and members belonging to the other web width adjusting devices to perform the width adjusting operation in the whole printing system shown in FIG. 1. Additionally, the control means 4 may be communicated with the driving and detecting means through any type of radio communication system (not shown). The counter pressure applying means 2 may be positioned downstream or upstream of the web traveling direction or opposite to the pressure applying means 1. The first shifting means 3 and the second shifting means 7 may be independently controlled by two different control systems.

Figure 20:
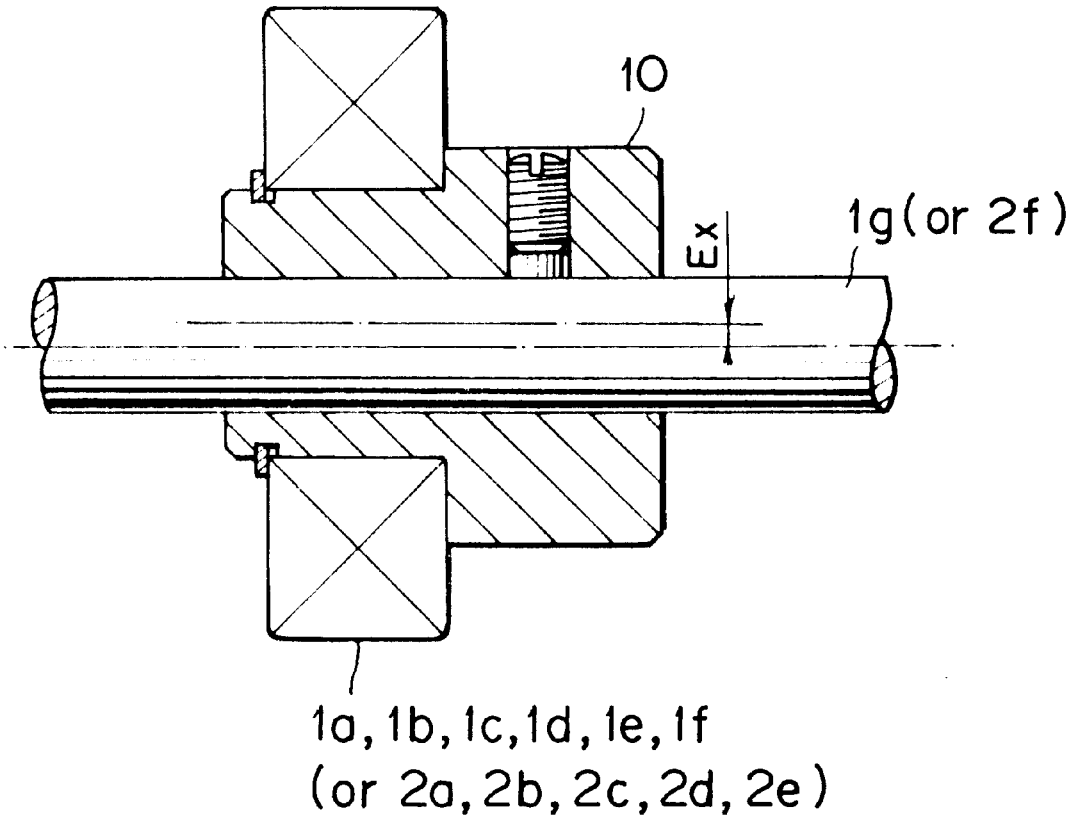
FIG. 20 is a cross sectional view showing another mechanism for shifting the pressure force applying means and the counter pressure applying means with respect to the paper web.

FIG. 20 shows one example of eccentric member 10 for shifting the contact rollers 1*a* to 1*f* and 2*a* to 2*e* the brush rollers 1*a*' to 1*f*' and 2*a*' to 2*e*' of the pressure force applying means 1 and the counter pressure applying means 2 with respect to the paper web.

For example, in the web width adjusting device 20 shown in FIG. 9, the shafts 1*g* and 2*f* are respectively supported by the eccentric sleeves 3*a* and 3*b*, 3*p* and 3*q* to eccentrically turn the shafts 1*g* and 2*f* by the rotation of the eccentric sleeves 3*a* and 3*b*, 3*p* and 3*q*, so that the contact rollers 1*a* to 1*f* and 2*a* to 2*e* are simultaneously turned. The contact rollers 1*a* to 1*f* and 2*a* to 2*e* may also be independently mounted on the shafts 1*g* and 2*f* by the eccentric member 10 shown in FIG. 20 to independently turn the contact rollers 1*a* to 1*f* and 2*a* to 2*e* with respect to the paper web W.

Figure 21:
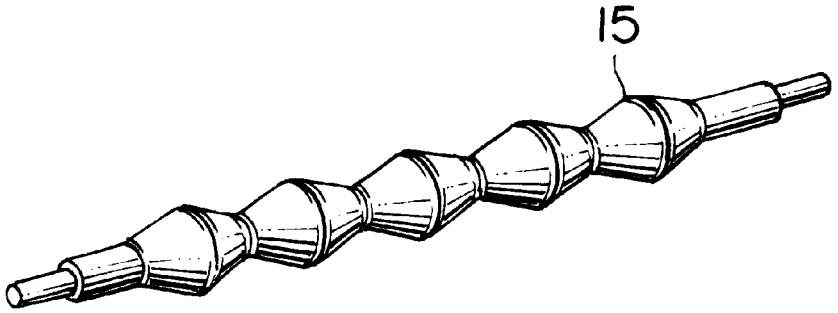
FIG. 21 is schematically perspective view showing another modification of pressure force applying rod adapted for the width adjusting device according to the present invention.
Figure 22:
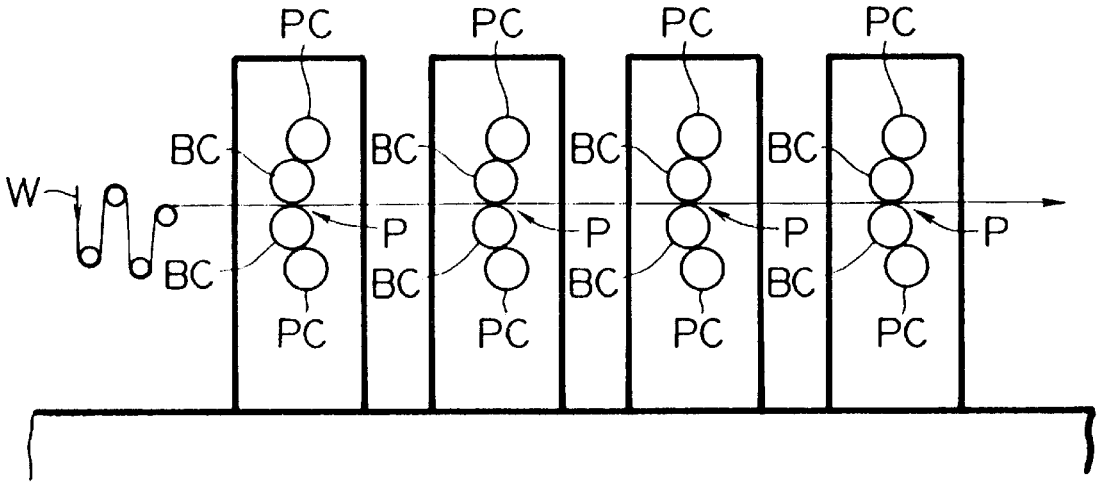
FIG. 22 PRIOR ART
FIG. 22 is schematic illustration showing one conventional configuration of commonly used rotary lithographic press.
Figure 23:
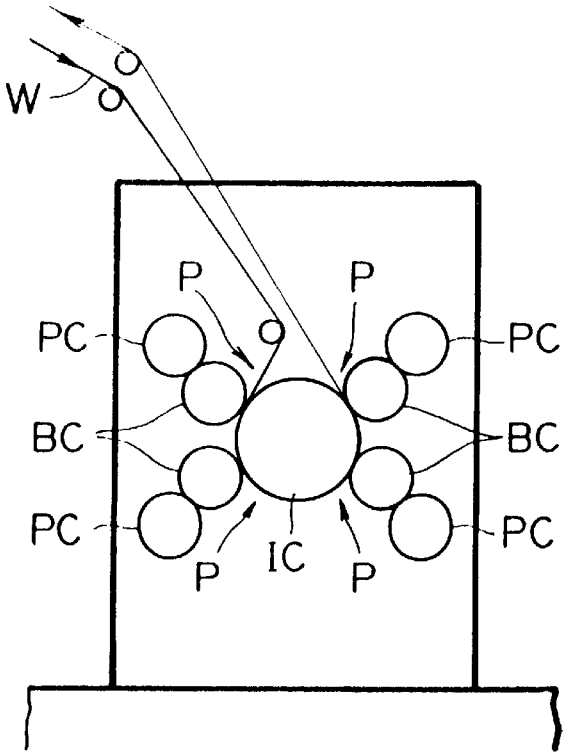
FIG. 23 PRIOR ART
FIG. 23 is a schematic illustration showing another conventional configuration of a commonly used rotary lithographic press.
Figure 24:
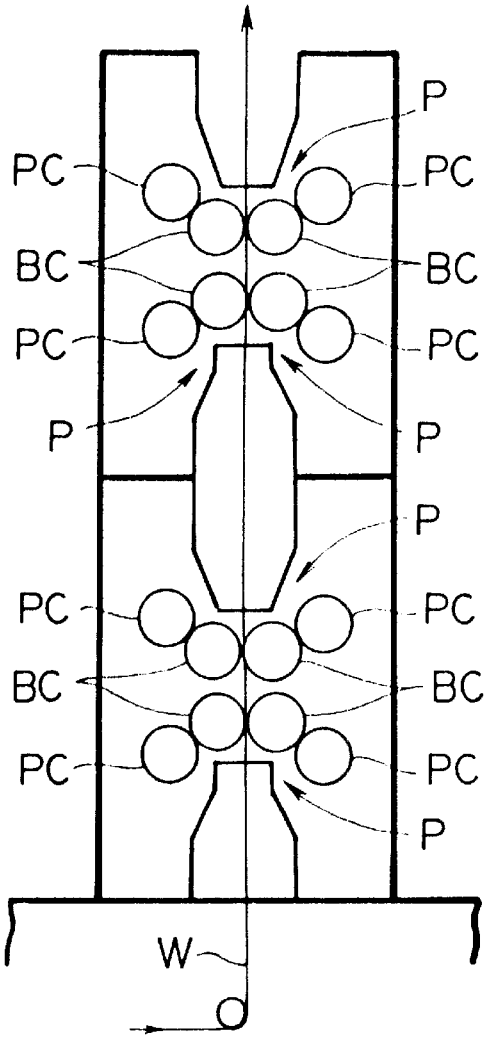
FIG. 24 PRIOR ART
FIG. 24 is a schematic illustration showing another conventional configuration of a commonly used rotary lithographic press.

FIG. 21 shows a knaggy shaft 15 which may be substituted for the shafts 1*h* and 2*g* having contact rollers, and the shafts 1*h*' and 2*g*' having brush rollers in the pressure force applying means 1 and the counter pressure applying means 2.

The web width adjusting device 20 is not limited to the above described embodiments. For example, the combination between the pressure force applying means 1 and the counter pressure applying means 2 may be varied in accordance with factors such as type of paper web, and the like. The flat surface rollers shown in FIG. 16 to FIG. 18 may be employed as the pressure force applying means 1, and the means 1 shown in FIG. 2 to FIG. 8 may be used as the counter pressure applying means 2 as required. Further the automatic control means 4 may be replaced by a manual control means, or both these control means may be selectively used.

A typical operation of the printing system using the web width adjusting devices will be described in conjunction with the drawings.

The paper web W is set in the printing system shown in FIG. 1 so that the web W is successively travelled through the printing sections P1, P2, P3, and P4 and passed through the operating zone of the pressure force applying means 1, or that operating zone defined between the pressure force applying means 1 and the counter pressure applying means 2 of the web width adjusting devices 20.

After or prior to the above described work, required information on the paper web such as width, material, thickness, and the like are input into the control means 4 through the input means 4*a*. The control means 4 outputs an activating signal to the driving motors 3*j*, 3*o* or 7*o* with reference to the detected signal from the detecting means 4*d* and 4*f* so that the pressure force applying means 1 and/or the counter pressure applying means 2 are positioned in their initial positions predetermined in response to the web information.

Additionally, in the case of using the fluid feeding and ejecting system, the fluid amount control unit 5 and the fluid pressure control unit 6 are adjusted with reference to the detected information from the detecting means 4*g* to feed the fluid under the initial condition such that the initial fluid amount and initial fluid pressure are predetermined in response to the information on the paper web W.

Then a start switch, not shown, for the printing system is turned on to start the traveling operation of the paper web W and printing operation of the printing sections P1, P2, P3, and P4.

As the printing sections begin their rotational work, the detecting means 4*b* detects the rotating speed of the main motor 50, representing the traveling speed of the paper web W, and inputs the detected information to the control means 4. According to the information on the traveling speed of the paper web W corresponding to the rotating speed of the main motor 50, the control means 4 outputs an adjusting signal to shift the pressure force applying means 1 and/or the counter pressure applying means 2 from their initial positions to predetermined adjusting positions. In the case of using fluid pressure, the fluid amount control unit 5 and the fluid pressure control unit 6 are adjusted from their initial state to an optimum state.

At the first printing section P1, the first image is printed on the paper web W and simultaneously blank sections of the printed web are supplied with dampening water though the blanket surface of the blanket cylinder BC. Thus, wetted fibers of the paper web W become gradually extending in the lateral direction of the web W while traveling from the first printing section P1 to the succeeding printing section, i.e., second printing section P2. When the web W is passed through the web width adjusting device 20, prior to the second printing section P2, the web W is subjected to contacting pressures by pressure force applying means 1 and/or the counter pressure applying means 2 so that the web W is deformed in a wavy surface WA. The wavy surface WA allows the primary width of the paper wave W to be decreased 11, 12; i.e., the resulted width is represented by "1" as shown in FIG. 2.

Although the wavy surface WA gradually returns to its primary shape after passing the web width adjusting device 20, the web width can not be completely returned to its primary width at the succeeding printing section (P2) and the paper web W with slightly smaller than its primary width is entered into the succeeding printing section (P2). Therefore, the extended width due to the dampening water at the preceding printing section (P1) may be cancelled by this shortened width. As a result, the paper web W without any faults such as visible rucks and the like is printed at the second printing section P2 so that the succeeding image can be printed in alignment with the preceding image. On the same occasion, the blank section of the paper web is supplied with dampening water through the blanket surface of the blanket cylinder BC in the same manner as the first printing section P1.

Next, the paper web W is successively traveled to the succeeding printing section; i.e., the third printing section P3 through another web width adjusting device 20 arranged prior to the third printing section P3. In this web width adjusting device 20, the paper web W is also subjected to the same adjusting operation as the former adjusting means.

Since the paper web W has been passed through the printing sections P1, P2, P3, and P4 and has been formed with printed patterns, the detecting means 4*c* gets the information on the printed patterns through the sensing element 4*e*. When the information is not in agreement with the predetermined value, the detecting means 4*c* will calculate the difference between the shears in the printed pattern in the central area of the paper web and that in both sides of the web, and input to the automatic control means 4. In accordance with the data from the detecting means 4*c*, the control means 4 will output a control signal to shift the pressure force applying means 1 and/or the counter pressure applying means 2 to correct the difference. In the case of fluid feeding system, the fluid amount control unit 5 and the fluid pressure control unit 6 are adjusted in response to the control signal from the control means 4 to adjust the fluid amount and fluid pressure applied to the paper web W.

In each of the web width adjusting devices 20, the position of the pressure force applying means 1 and/or the counter pressure applying means 2, or the fluid amount and fluid pressure against the paper web W should be adequately adjusted in response to the traveling speed of the paper web W because the wetted fibers will expand in proportion to time. In other words, the adjusting degree by the width adjusting device 20 should be largely adjusted when the paper web W is traveled at a slow speed.

According to the web width adjusting device 20, the web width at the succeeding printing section can be adjusted consistent with that of the preceding printing section. Thus the image lines printed at the first to fourth printing sections P1 to P4 can be formed in alignment with each other.

In the experimental test executed by the present applicant, a rolled newspaper type A (width 1626 mm) was used to clarify the difference between the effect obtained by the web width adjusting device 20 arranged as shown in FIG. 1 and that of conventional constitution without any web width adjusting means. This experimental test evidenced that shears (about 2 mm) generated in the width direction between the first printed image line and the fourth printed image line by conventional constitution can be wholly corrected by the web width adjusting device 20 according to the present invention. Although the expanding ratio in the web width depends on the type of paper web, the web width adjusting device according to the present invention can adequately compensate to eliminate shears in printing.

The automatic control means 4 may be replaced by manually control means.

The present invention is not limited to only the above described embodiments, and for example, the pressure force applying means 1 and/or the counter pressure applying means 2, the first shifting means 3 and/or the second shifting means 7 of the web width adjusting device 20 may be modified or replaced by any adequate structures. Further the control means 4 may be input with the information on the dampening water fed onto the web paper W at the printing sections P1 to P3; i.e., ratio between image and blank to be printed at the printing sections P1 to P3. Various changes and modifications are possible without departing from the spirit and claims of the invention.

As disclosed in the above description, since expansion in web width due to dampening can be adequately corrected by the web width adjusting device arranged between the preceding printing section and the succeeding printing section, the image-line printed at the succeeding printing section can be completely aligned with the former image line, thereby producing a high quality printed matters without any shears or uncleanness.

What is claimed is:

1. A web width adjusting method for a printing system having a plurality of printing steps using dampening water, comprising:

at least one step for applying pressure force to one side surface of a paper web at a first location along a paper web traveling direction in said printing system to form a wavy surface so that the width of the paper web can be adjusted to accord the printed pattern formed at a preceding printing step and that formed at a succeeding printing step; and at least one step for applying counter pressure to the other side surface of the paper web at a second location along said paper web traveling direction in said printing system that is different than said first location so that said counter pressure selectively assists said pressure force in forming said wavy surface.

2. A printing system comprising:

a plurality of printing sections using dampening water; and a web width adjusting device arranged between two of said printing sections, said web width adjusting device comprising:

a pressure force applying means for applying pressure force to one side surface of a paper web at a first location along a paper web traveling direction between said two printing sections;

a pressure adjusting means for adjusting the pressure applied to the web surface by said pressure force applying means; and a counter pressure applying means for applying counter pressure to the other side surface of the paper web at a second location along said paper web traveling direction between said two printing sections that is different than said first location, wherein said pressure force applying means includes a plurality of contact rollers which are separated from each other at a regular interval and rotatably mounted on a shaft extended in the lateral direction of the paper web.

3. The printing system as set forth in claim 2, wherein said counter pressure applying means includes a second plurality of contact rollers which are separated from each other at a regular interval to be shifted with respect to said contact rollers on the shaft of said pressure force applying means and rotatably mounted on a second shaft extended in the lateral direction of the paper web.

4. A printing system comprising:

a plurality of printing sections using dampening water; and a web width adjusting device arranged between two of said printing sections, said web width adjusting device comprising:

a pressure force applying means for applying pressure force to one side surface of a paper web at a first location along a paper web traveling direction between said two printing sections;

a pressure adjusting means for adjusting the pressure applied to the web surface by said pressure force applying means;

a counter pressure applying means for applying counter pressure to the other side surface of the paper web at a second location along said paper web traveling direction between said two printing sections that is different than said first location, wherein said pressure force applying means includes a first contact shaft with a plurality of convex sections which are separated from each other at a regular interval, said first contact shaft being extended in the lateral direction of the paper web.

5. The printing system as set forth in claim 4, wherein said counter pressure applying means includes a second contact shaft with a plurality of convex sections which are separated from each other at a regular interval to be shifted with respect to said convex sections formed on the shaft of said pressure force applying means, said second contact shaft being extended in the lateral direction of the paper web.

6. A printing system comprising:

a plurality of printing sections using dampening water; and a web width adjusting device arranged between two of said printing sections, said web width adjusting device comprising:

a pressure force applying means for applying pressure force to one side surface of a paper web at a first location along a paper web traveling direction between said two printing sections;

a pressure adjusting means for adjusting the pressure applied to the web surface by said pressure force applying means;

a counter pressure applying means for applying counter pressure to the other side surface of the paper web at a second location along said paper web traveling direction between said two printing sections that is different than said first location, wherein said pressure force applying means includes a first plurality of brush rollers which are separated from each other at a regular interval and rotatably mounted on a first shaft extended in the lateral direction of the paper web.

7. The printing system as set forth in claim 6, wherein said counter pressure applying means includes a second plurality of brush rollers which are separated from each other at a regular interval to be shifted with respect to said first plurality of brush rollers on the shaft of said pressure force applying means and rotatably mounted on a second shaft extended in the lateral direction of the paper web.

8. A printing system comprising:

a plurality of printing sections using dampening water; and a web width adjusting device arranged between two of said printing sections, said web width adjusting device comprising:

a pressure force applying means for applying pressure force to one side surface of a paper web at a first location along a paper web traveling direction between said two printing sections;

a pressure adjusting means for adjusting the pressure applied to the web surface by said pressure force applying means;

a counter pressure applying means for applying counter pressure to the other side surface of the paper web at a second location along said paper web traveling direction between said two printing sections that is different than said first location, wherein said pressure force applying means includes a first contact shaft with a plurality of brush convex sections which are separated from each other at a regular interval, said first contact shaft being extended in the lateral direction of the paper web.

9. The printing system as set forth in claim 8, wherein said counter pressure applying means includes a second contact shaft with a plurality of brush convex sections which are separated from each other at a regular interval to be shifted with respect to said brush convex sections formed on the shaft of said pressure force applying means, said second contact shaft being extended in the lateral direction of the paper web.

10. A printing system comprising:

a plurality of printing sections using dampening water; and a web width adjusting device arranged between two of said printing sections, said web width adjusting device comprising:

a pressure force applying means for applying pressure force to one side surface of a paper web at a first location along a paper web traveling direction between said two printing sections;

a pressure adjusting means for adjusting the pressure applied to the web surface by said pressure force applying means;

a counter pressure applying means for applying counter pressure to the other side surface of the paper web at a second location along said paper web traveling direction between said two printing sections that is different than said first location, wherein said pressure force applying means includes a first plurality of cam-shaped members which are separated from each other at a regular interval and fixedly mounted on a first shaft extended in the lateral direction of the paper web.

11. The printing system as set forth in claim 10, wherein said counter pressure applying means includes a second plurality of cam-shaped members which are separated from each other at a regular interval to be shifted with respect to said cam-shaped members on the shaft of said pressure force applying means, and fixedly mounted on a second shaft extended in the lateral direction of the paper web.

12. A printing system comprising:

a plurality of printing sections using dampening water; and a web width adjusting device arranged between two of said printing sections, said web width adjusting device comprising:

a pressure force applying means for applying pressure force to one side surface of a paper web at a first location along a paper web traveling direction between said two printing sections;

a pressure adjusting means for adjusting the pressure applied to the web surface by said pressure force applying means;

a counter pressure applying means for applying counter pressure to the other side surface of the paper web at a second location along said paper web traveling direction between said two printing sections that is different than said first location, wherein said pressure force applying means includes a first contact shaft with a plurality of partial convex sections which are separated from each other at a regular interval, said first contact shaft being extended in the lateral direction of the paper web.

13. The printing system as set forth in claim 12, wherein said counter pressure applying means includes a second contact shaft with a plurality of partial convex sections which are separated from each other at a regular interval to be shifted with respect to said partial convex sections formed on the shaft of said pressure force applying means, said second contact shaft being extended in the lateral direction of the paper web.

14. A printing system comprising:

a plurality of printing sections using dampening water; and a web width adjusting device arranged between two of said printing sections, said web width adjusting device comprising:

a pressure force applying means for applying pressure force to one side surface of a paper web at a first location alone a paper web traveling direction between said two printing sections;

a pressure adjusting means for adjusting the pressure applied to the web surface by said pressure force applying means;

a counter pressure applying means for applying counter pressure to the other side surface of the paper web at a second location along said paper web traveling direction between said two printing sections that is different than said first location, wherein said pressure force applying means includes a first fluid feeding pipe with a plurality of fluid ejectors which are separated from each other at a regular interval, said first fluid feeding pipe being extended in the lateral direction of the paper web.

15. The printing system as set forth in claim 14, wherein said counter pressure applying means includes a second fluid feeding pipe with a plurality of fluid ejectors which are separated from each other at a regular interval to be shifted with respect to said fluid ejectors arranged on the pipe of said pressure force applying means, said second fluid feeding pipe being extended in the lateral direction of the paper web.

16. A printing system comprising:

a plurality of printing sections using dampening water; and a web width adjusting device arranged between two of said printing sections, said web width adjusting device comprising:

a pressure force applying means for applying pressure force to one side surface of a paper web at a first location along a paper web traveling direction between said two printing sections;

a pressure adjusting means for adjusting the pressure applied to the web surface by said pressure force applying means;

a counter pressure applying means for applying counter pressure to the other side surface of the paper web at a second location along said paper web traveling direction between said two printing sections that is different than said first location, wherein said counter pressure applying means includes an air bag roller with an elastic flat contact surface, said roller being extended in the lateral direction of the paper web.

17. A printing system comprising:

a plurality of printing sections using dampening water; and a web width adjusting device arranged between two of said printing sections, said web width adjusting device comprising:

a pressure force applying means for applying pressure force to one side surface of a paper web at a first location along a paper web traveling direction between said two printing sections;

a pressure adjusting means for adjusting the pressure applied to the web surface by said pressure force applying means;

a counter pressure applying means for applying counter pressure to the other side surface of the paper web at a second location along said paper web traveling direction between said two printing sections that is different than said first location, wherein said counter pressure applying means includes a brush roller with a brush continuous surface, said brush roller being extended in the lateral direction of the paper web.

18. A printing system comprising:

a plurality of printing sections using dampening water; and a web width adjusting device arranged between two of said printing sections, said web width adjusting device comprising:

a pressure force applying means for applying pressure force to one side surface of a paper web at a first location along a paper web traveling direction between said two printing sections, a pressure adjusting means for adjusting the pressure applied to the web surface by said pressure force applying means;

a counter pressure applying means for applying counter pressure to the other side surface of the paper web at a second location along said paper web traveling direction between said two printing sections that is different than said first location, wherein said counter pressure applying means includes a sponge roller with a sponge continuous surface, said roller being extended in the lateral direction of the paper web.

19. A rotary lithographic press comprising:

a plurality of printing sections with a dampening unit, said printing sections being arranged along a paper web traveling direction; and a plurality of web width adjusting devices being arranged between two sets of said printing sections, each adjusting device including a pressure force applying means for applying pressure force to one side surface of a paper web at a first location along said paper web traveling direction to deform the paper web in a wavy surface which causes the width of the paper web to be shortened;

a pressure adjusting means for adjusting the pressure applied to the web surface by said pressure force applying means;

wherein said web width adjusting device further includes a counter pressure applying means for applying counter pressure to the other side surface of the paper web at a second location, different than said first location, along said paper web traveling direction.

* * * * *